US010833436B2

(12) United States Patent
Coteus et al.

(10) Patent No.: US 10,833,436 B2
(45) Date of Patent: Nov. 10, 2020

(54) INTERDIGITATED POWER CONNECTOR

(71) Applicant: International Business Machines Corporation, Armonk, NY (US)

(72) Inventors: Paul W. Coteus, Yorktown, NY (US); Andrew Ferencz, Southborough, MA (US); Shawn A. Hall, Pleasantville, NY (US); Todd E. Takken, Brewster, NY (US)

(73) Assignee: International Business Machines Corporation, Armonk, NY (US)

( * ) Notice: Subject to any disclaimer, the term of this patent is extended or adjusted under 35 U.S.C. 154(b) by 281 days.

(21) Appl. No.: 15/853,806

(22) Filed: Dec. 24, 2017

(65) Prior Publication Data

US 2019/0199019 A1 Jun. 27, 2019

(51) Int. Cl.

| | |
|---|---|
| ***H01R 4/00*** | (2006.01) |
| ***H01R 12/51*** | (2011.01) |
| ***H01R 4/36*** | (2006.01) |
| ***H01R 12/52*** | (2011.01) |
| ***H01R 12/70*** | (2011.01) |
| ***H01R 13/66*** | (2006.01) |

(Continued)

(52) U.S. Cl.

CPC ..... *H01R 12/515* (2013.01); *H01R 4/30* (2013.01); *H01R 4/363* (2013.01); *H01R 12/523* (2013.01); *H01R 12/7088* (2013.01); *H01R 12/73* (2013.01); *H01R 13/6625* (2013.01)

(58) Field of Classification Search

CPC .... H01R 12/515; H01R 4/363; H01R 12/523; H01R 13/6625; H01R 4/30; H01M 10/0525; H01M 10/0565; H01M 4/664

See application file for complete search history.

(56) References Cited

U.S. PATENT DOCUMENTS

| | | | |
|---|---|---|---|
| 3,497,860 | A | 2/1970 | Jorgensen et al. |
| 4,820,169 | A | 4/1989 | Weber et al. |
| 4,881,905 | A | 11/1989 | Demler et al. |

(Continued)

OTHER PUBLICATIONS

Shuo Wang et al., "Power connector parameter analysis by 2D". In Eighteenth Annual Applied Power Electronics Conference and Exposition. Feb. 2003. vol. 2, pp. 751-755. IEEE.

(Continued)

*Primary Examiner* — Cynthia H Kelly
*Assistant Examiner* — Monique M Wills
(74) *Attorney, Agent, or Firm* — Daniel Morris; Otterstedt, Wallace & Kammer, LLP

(57) ABSTRACT

An electrical connector carries large amounts of electrical current between two circuit boards with low resistance and low self-inductance by means of an interdigitated anode and cathode, thereby providing low dynamic voltage loss. The connector also may include, near where power will be consumed, an interposer board with on-board capacitance to provide even lower dynamic voltage loss. The connector has application to delivering low-voltage, high-current power from a power supply on a first board to electronics on a second board: the low resistance provides low voltage drop for a load current that is constant, while the low inductance and the capacitors provide low voltage fluctuation for a load current that changes. These issues are of great importance, for example, in designing high-performance computers.

19 Claims, 20 Drawing Sheets

(51) Int. Cl.
*H01R 4/30* (2006.01)
*H01R 12/73* (2011.01)

(56) References Cited

U.S. PATENT DOCUMENTS

| | | | | |
|---|---|---|---|---|
| 6,224,430 | B1 | 5/2001 | Kusuda et al. | |
| 6,290,514 | B1 | 9/2001 | McHugh et al. | |
| 6,392,899 | B1 | 5/2002 | Harrison et al. | |
| 6,821,128 | B2 | 11/2004 | Belopolsky et al. | |
| 7,798,851 | B2 | 9/2010 | Lin et al. | |
| 2011/0255250 | A1* | 10/2011 | Dinh | G03B 15/03 361/749 |
| 2017/0214083 | A1* | 7/2017 | Darolles | H01M 4/665 |

OTHER PUBLICATIONS

Donald E. Wood et al., "High performance, low impedance power interconnects". In Eighteenth Annual Applied Power Electronics Conference and Exposition. Feb. 2003. vol. 2, pp. 747-750. IEEE.

* cited by examiner

400

906

INTERDIGITATED POWER CONNECTOR

FEDERALLY SPONSORED RESEARCH AND DEVELOPMENT

This invention was made with government support under contract B601996 awarded by the Department of Energy. The government has certain rights in the invention.

BACKGROUND

In the field of electronics, and in particular in the field of high-performance computers, it is highly desirable to reduce the consumption of electrical power as much as possible. Toward this end, new generations of power supplies are designed to minimize loss, and new generations of processors and memory systems are designed to dissipate less power despite higher computational performance. An effective technique in reducing the power consumption P of electronics is to lower the operating voltage V. Yet, because P=VI, where I is current in amperes flowing through the electronics, reduced voltage V implies higher current I, despite reduction in power P.

Thus, for such low-voltage, high-current electronics, a power connector must be capable of handling large current I. The current I must be delivered substantially at potential V from a supply terminal of a power supply to the electronics, and must be returned substantially at zero potential from the electronics to a return terminal of the power supply. A power-connector terminal connecting to the supply terminal of the power supply is called an "anode", whereas a power-connector terminal connecting to the return terminal of the power supply call a "cathode". The supply-terminal potential and the return-terminal potential may be referred to as "power" and "ground" respectively. Let $\Delta V_s$ be the voltage drop that occurs as current I travels from the supply terminal to the electronics; let $\Delta V_r$ be the voltage drop that occurs as current I travels from the electronics to the return terminal; and let $\Delta V_o$ be other overhead voltage drop that occurs, such as in conductors other than the connector. Let $R_s$, $R_r$, and $R_o$ be the resistances corresponding to the voltage drops $\Delta V_s$, $\Delta V_r$ and $\Delta V_o$ respectively; that is, $$\Delta V_s = IR_s;\ \Delta V_r = IR_r;\ \Delta V_o = IR_o. \tag{1}$$

A total overhead voltage drop $\Delta V_{TOTAL}$ may therefore be defined as $$\Delta V_{TOTAL} \equiv \Delta V_s + \Delta V_r + \Delta V_o = I(R_s + R_r + R_o) \tag{2}$$

For electronics such as a processor and memory, another common method of power reduction is to reduce, as processor workload changes, the processor's operating voltage V and/or a clock frequency f at which the processor operates. A popular technique is called dynamic voltage-frequency scaling (DVFS), in which both V and f are dropped proportionally when workload is reduced, and raised again when workload is increased. Consequently, the current I from the power supply to the processor and memory varies strongly in time. This leads to voltage fluctuation at the processor and memory, because an inductive voltage drop $\Delta V_L$ occurs across the power connector according to Faraday's Law, $$\Delta V_L = L\frac{dI}{dt}, \tag{3}$$

where L is a self-inductance of the power connector and $$\frac{dI}{dt}$$

is a change in current per unit time through the connector. Because a technique such as DVFS can produce large $$\frac{dI}{dt},$$

the self-inductance L of the power connector must be small, according to equation (3), to avoid large voltage fluctuations $\Delta V_L$.

Some prior-art, high-current power connectors achieve (1) and (2), but fail to achieve (3). For example, a power connector comprising an array of pins, with each pin being either power or ground, has relatively high self-inductance. Other prior-art connectors, such as coaxial or stripline connectors, achieve (3) but fail to achieve (1): they are typically restricted to just a few amperes of current per contact.

Thus it is highly desirable to find a connector structure that achieves (1), (2), and (3) simultaneously, and does so in a compact package for the purpose of reducing $R_o$. For example, a useful target set of specifications is $$I = 100\text{ A};\ R_{CONN} \equiv R_s + R_r \leq 50\mu\Omega;\ L_{CONN} \leq 500\text{ pH}, \tag{4}$$

where the inductance specification in (4) arises from a desire to achieve a dynamic voltage drop of at most $\Delta V_L = 50$ [mV] with $$\frac{dI}{dt} = 100\frac{A}{\mu s}.$$

SUMMARY

Principles of the invention provide techniques for an interdigitated power connector that achieves relatively low resistance and inductance. In one aspect, an exemplary apparatus includes an electrical connector for conducting current substantially parallel to a z direction of a Cartesian coordinate system having an x axis, a y axis, and a z axis, all mutually orthogonal, thereby defining an xy plane spanned by the x and y axes, an xz plane spanned by the x and z axes, and a yz plane spanned by the y and z axes. In this context, the electrical connector includes an anode formed into a first shape of uniform cross-section along the z direction, the first shape having a plurality of anode fingers that alternate with a plurality of anode gaps; and a cathode formed into a second shape of uniform cross-section along the z direction, the second shape having a plurality of cathode fingers that alternate with a plurality of cathode gaps. The first and second shapes provide a conformity of one to the other, with the anode fingers being interdigitated with the cathode fingers and separated from the cathode fingers by an insulative anode-to-cathode gap.

In another aspect, an exemplary apparatus includes an electrical connector for conducting current substantially parallel to a z direction of a Cartesian coordinate system having an x axis, a y axis, and a z axis, all mutually orthogonal, thereby defining an xy plane spanned by the x and y axes, an xz plane spanned by the x and z axes, and a yz plane spanned by the y and z axes. In this context, the electrical connector includes an anode formed into a first shape of uniform cross-section along the z direction, the first shape having a plurality of anode fingers that alternate with a plurality of anode gaps; a cathode formed into a second shape of uniform cross-section along the z direction, the second shape having a plurality of cathode fingers that alternate with a plurality of cathode gaps; and an interposer assembly, which is attached on its positive-z-facing surface to the negative-z-facing surfaces of the anode and cathode, the interposer assembly having an interposer printed-circuit board and a plurality of capacitors affixed to the interposer printed-circuit board to provide a capacitance. The first and second shapes provide a conformity of one to the other, with the anode fingers being interdigitated with the cathode fingers and separated from the cathode fingers by an insulative anode-to-cathode gap. The anode and the cathode are indented with slots at their negative-z-facing surfaces, and the capacitors of the interposer assembly fit into the slots of the anode and the cathode.

In another aspect, an exemplary method for reducing dynamic voltage drop in a board-to-board assembly includes connecting a source printed-circuit board to a destination printed-circuit board via an interdigitated electrical connector, which includes an anode formed into a first shape of uniform cross-section along a z direction, the first shape having a plurality of anode fingers that alternate a plurality of anode gaps, and a cathode formed into a second shape of uniform cross-section along the z direction, the second shape having a plurality of cathode fingers that alternate with a plurality of cathode gaps. The first and second shapes provide a conformity of one to the other, with the anode fingers being interdigitated with the cathode fingers and separated from the cathode fingers by an insulative anode-to-cathode gap. The exemplary method further includes providing a time-varying current from the source to the destination via the interdigitated electrical connector.

The invention provides substantial technical benefits, including reduced resistance and inductance compared to prior art connectors. Moreover, the invention provides a relatively compact solution for efficiently conducting relatively high and rapidly varying currents from source to destination. Furthermore, one or more embodiments advantageously provide (1) high current-carrying capacity, (2) low connector resistance $R_{CONN}=R_s+R_r$, and (3) low self-inductance $L_{CONN}$.

These and other features and advantages of the present invention will become apparent from the following detailed description of illustrative embodiments thereof, which is to be read in connection with the accompanying drawings.

DETAILED DESCRIPTION

Description and Operation of a First Embodiment (FIGS. 1-7)

Figure 1:
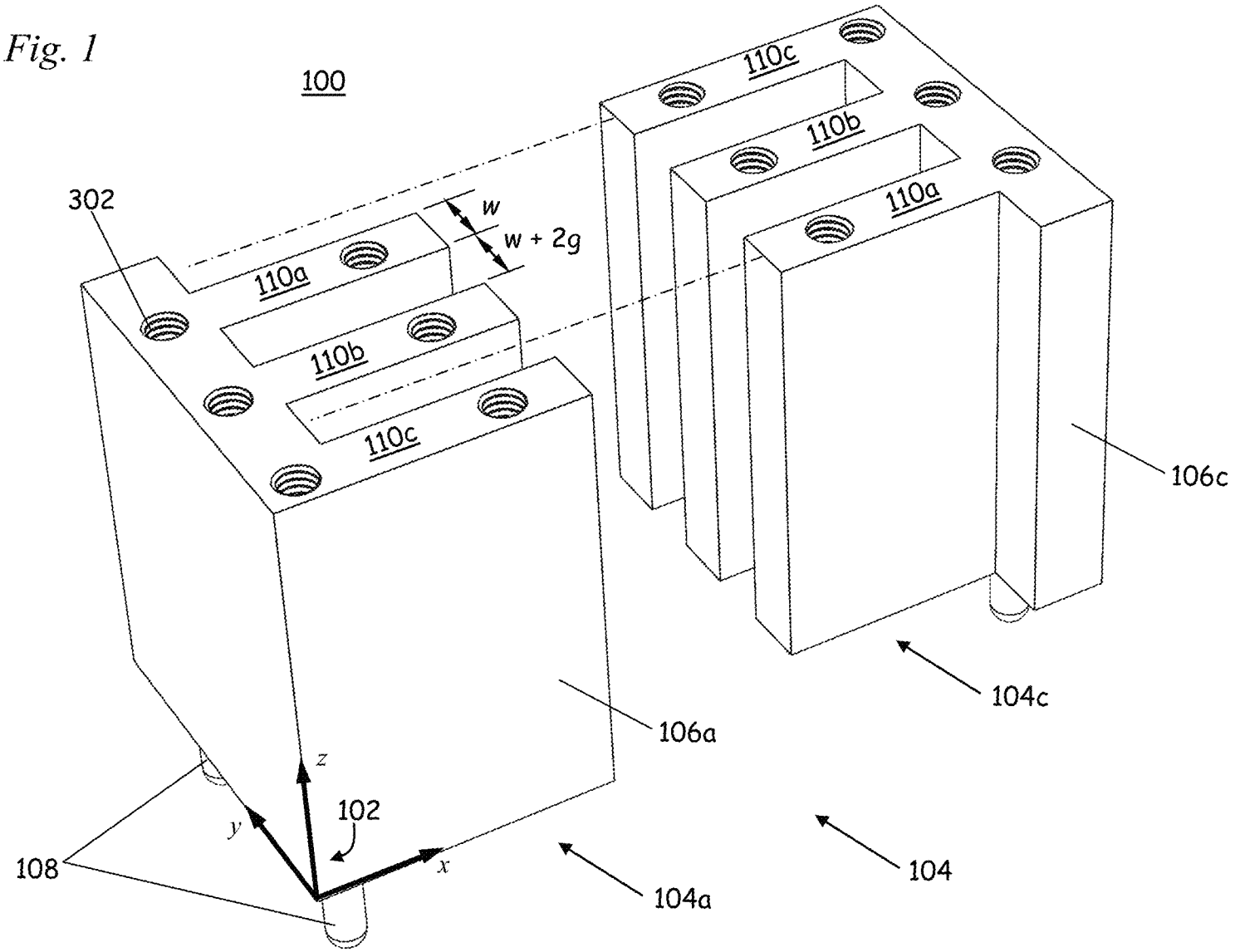
FIG. 1 illustrates an exploded view of a power connector according to a first embodiment.
Figure 2:
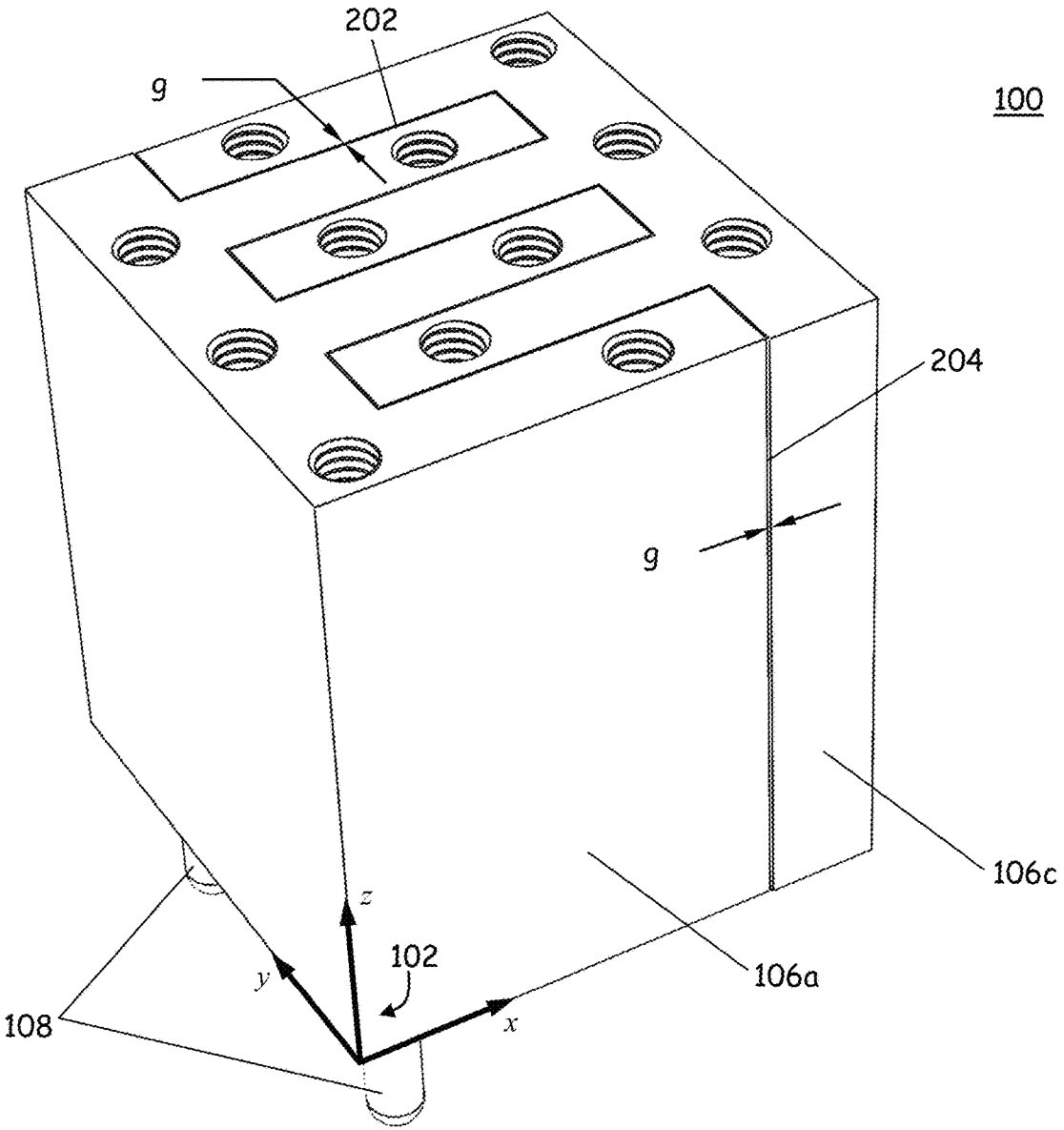
FIG. 2 illustrates an assembled view of the power connector of FIG. 1.
Figure 3:
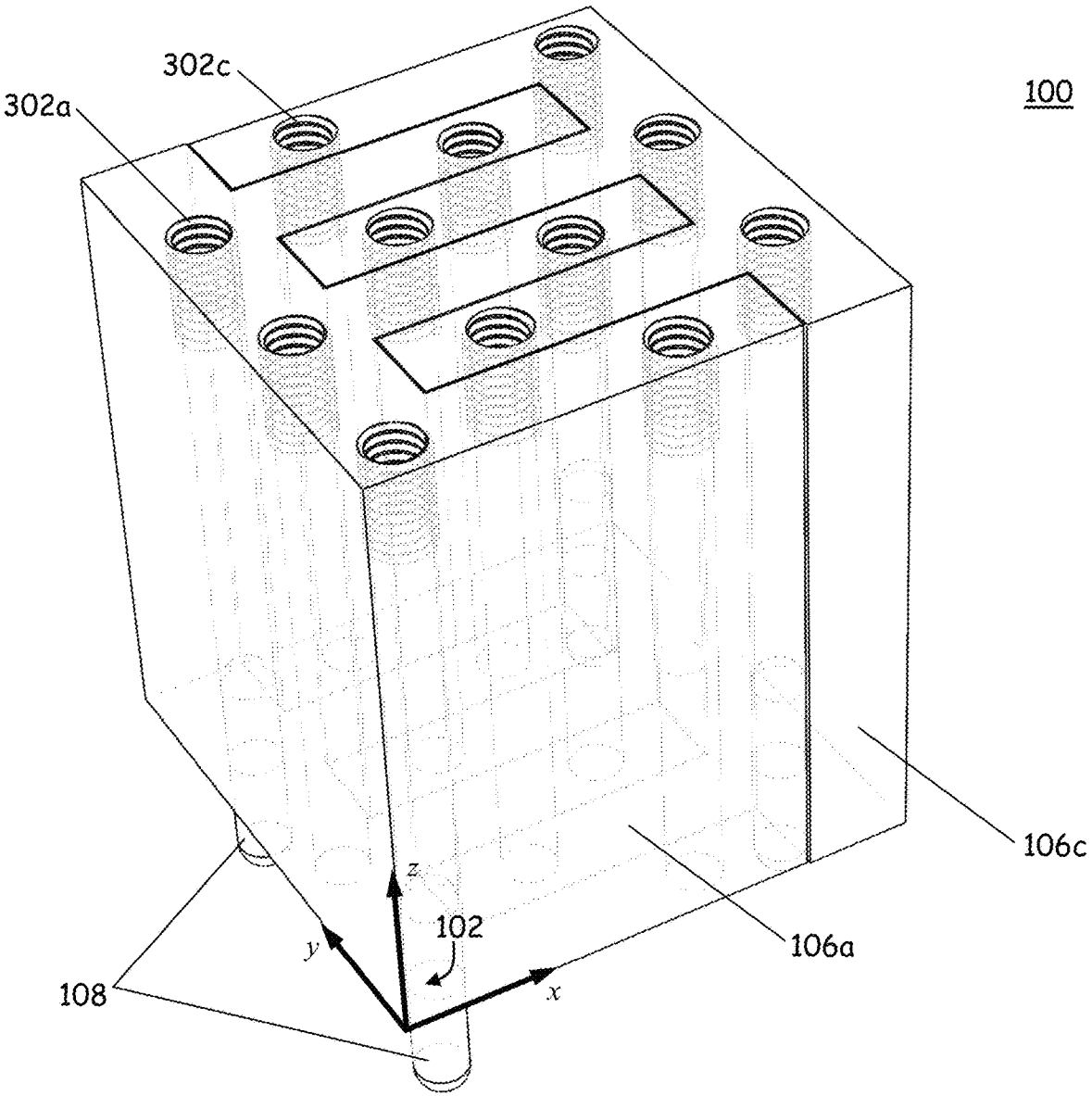
FIG. 3 illustrates an assembled view of the power connector of FIG. 1 with anode and cathode transparent.

FIGS. 1 through 3 illustrate a first embodiment of an interdigitated power connector 100 that achieves low resistance and low self-inductance in a compact space. Connector 100 will be described in the context of a Cartesian coordinate system 102 that includes an x axis, a y axis, and a z axis, all mutually orthogonal, thereby defining an xy plane spanned by the x axis and the y axis, an xz plane spanned by the x axis and the z axis, and a yz plane spanned by they axis and the z axis. The connector 100 includes two identical electrodes assemblies, including an anode assembly 104*a* and a cathode assembly 104*c*. These two assemblies are shown exploded on FIG. 1. They are shown assembled on FIG. 2 and FIG. 3; FIG. 3 shows connector 100 as "transparent", so that lines normally hidden are revealed. Referring to anode assembly 104*a* on FIG. 1, each of the identical electrode assemblies includes an electrode 106*a* or 106*c* and two locating pins 108. For anode assembly 104*a*, the electrode is called an anode 106*a*; for the identical cathode assembly 104*c*, the electrode is called a cathode 106*c*. Each electrode 106*a* or 106*c* includes a plurality of fingers 110, instances of which are denoted 110*a*, 110*b* and 110*c*. The width of each finger in they direction is denoted w. Fingers 110 are separated by interdigit spaces; the width of each interdigit space in they direction is denoted w+2g. The anode 106*a* and the cathode 106*b* can be manufactured of any suitable conductive material, including for example copper.

Consequently, referring to FIG. 2, when the two electrodes are assembled, a side gap 202 of dimension g is provided in the y direction between each finger of the anode and the adjacent finger of the cathode. An end gap 204 of dimension g is also provided in the x direction where a fingertip on one of the electrodes approaches a finger-base on the other electrode. Consequently, because of gaps 202 and 204, the anode and the cathode are electrically insulated from each other. The side and end gaps may be filled with an insulator such as vacuum, air, or any other insulating material that, for example, may be applied as a coating to a plurality of interdigit surfaces, the interdigit surfaces being formed by the positive-y-facing and negative-y-facing surfaces of each finger, excluding the end surfaces of assembly 100, as well as the positive-x-facing and negative-x-facing surfaces of each finger.

Referring to FIG. 3, anode 106*a* is formed with a plurality of holes 302*a*, and cathode 106*c* is formed with a plurality of holes 302*c*. As illustrated in FIG. 3, holes 302*a* and 302*c* may be through holes, as may be economically formed if the electrode is extruded, for example. Alternatively, holes 302*a* and 302*c* may be blind on each end. In either case, on the negative-z-facing surface of the electrode, locating pins 108 are press fit into two of the holes in each electrode. Near the positive-z-facing surface of the electrode, each of the holes 302*a* and 302*c* has a threaded portion.

Figure 4:
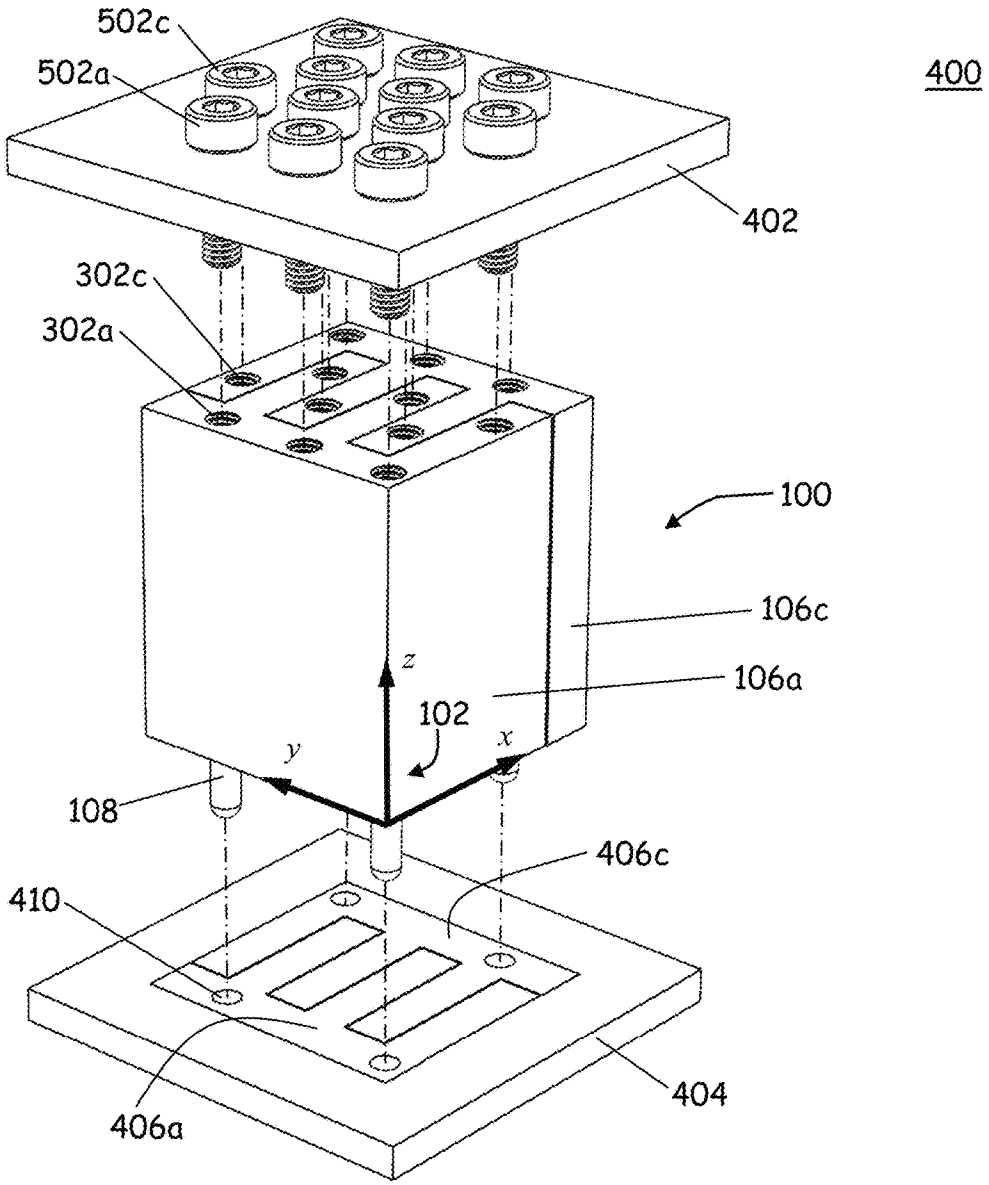
FIG. 4 illustrates an exploded view of a board-to-board assembly including the power connector of FIG. 1.

FIG. 4 illustrates an exploded view of a board-to-board assembly 400 depicting typical deployment of the connector assembly 100. Connector 100 transmits a power domain, characterized by its anode-voltage $V_1$, from a first printed circuit board (PCB) 402, where voltage $V_1$ is generated, to a second PCB 404, where voltage $V_1$ is used to power various electronic devices.

Connector 100 is located with respect to PCB 404 by locating pins 108, which engage holes 410. Connector 100 is soldered to PCB 404 using copper pads 406 printed thereon by means well known in the art of PCB manufacturing; specifically, the negative-z-facing surface of anode 106*a* is soldered to a copper pad 406*a*, and the negative-z-facing surface of cathode 106*c* is soldered to a copper pad 406*c*. As will be further discussed below, attachment means other than the copper pads and the locating pins may be used (e.g., threaded fasteners).

Figure 5:
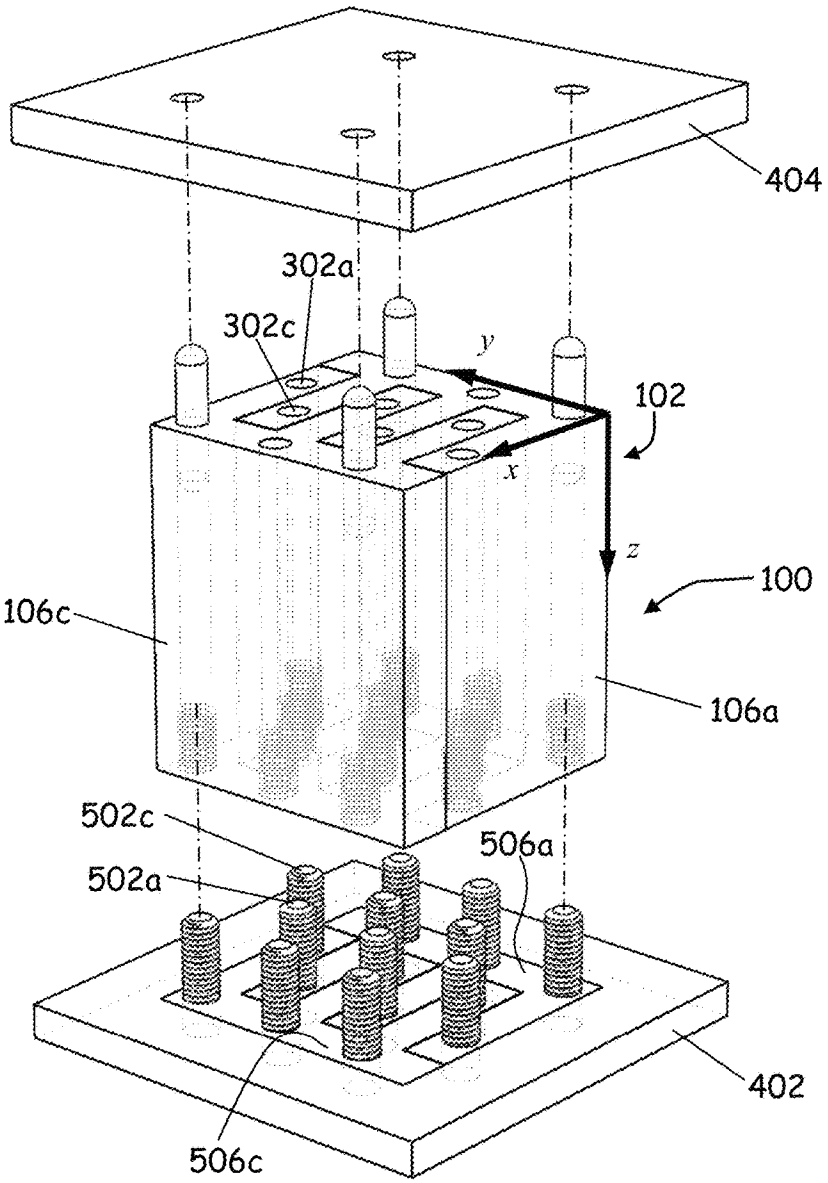
FIG. 5 illustrates an upside-down exploded view of the board-to-board assembly of FIG. 4.

FIG. 5 is an upside-down exploded diagram of assembly 400 that illustrates an attachment of connector 100 to PCB 402. Connector 100 is shown as transparent. The attachment of connector 100 to PCB 402 is achieved with a plurality of anode fasteners 502*a* and a plurality of cathode fasteners 502*c*. The fasteners pass through clearance holes in PCB 402. These fasteners engage the threaded portions of holes 302*a* and 302*c* respectively. As shown, PCB 402 includes a copper pad 506*a*, printed on the negative-z-facing surface thereof, whose multi-finger shape matches that of anode 106*a*. Likewise, PCB 402 includes a copper pad 506*c* whose multi-finger shape matches that of cathode 106*c*. A threaded portion of fasteners 502*a* pass through clearance holes in PCB 402 that penetrate pad 506*a*. Likewise, a threaded portion of fasteners 502*c* pass through clearance holes in PCB 402 that penetrate pad 506*c*. Tightening fasteners 502*a* achieves a low-resistance anode connection for connector 100 by pulling the positive-z-facing surface of anode 106*a* with high normal force against pad 506*a*. Likewise, tightening fasteners 502*c* achieves a low-resistance cathode connection for connector 100 by pulling the positive-z-facing surface of cathode 106*c* with high normal force against pad 506*c*. As discussed above, attachment means other than threaded fasteners may be used (e.g., solder).

The low-resistance connections referred to above are best achieved when the positive-z-facing surfaces of the electrodes 106*a* and 106*c* are coplanar. Coplanarity is best achieved by temporarily affixing, prior to soldering the negative-z-facing surfaces of the electrodes to PCB 404, a substantially rigid plate to the positive-z-facing surfaces of the electrodes, using fasteners such as 502*a* and 502*c*. This insures that the soldering process will not spoil the coplanarity of the positive-z-facing surfaces.

Operation of the first embodiment includes electrical performance of connector 100; in particular, the resistance and inductance thereof.

Resistance $R_{CONN}$ for connector 100 per se is $$R_{CONN} = 2\frac{\rho \ell_1}{A_1}, \tag{5}$$

where ρ is the resistivity of the electrode material, $\ell_1$ is a length of the electrode in the z direction, and $A_1$ is a cross-sectional area of the electrode parallel to the xy plane. Equation (5) ignores contact resistance at the fasteners, which is estimated separately later. The factor of two in equation (5) accounts for the presence of two electrodes, 106*a* and 106*c*, that form the connector 100. For a prototype of connector 100 in which the electrodes are copper, $l_1$=29 [mm] and $A_1$=282 [mm$^2$], whence $$R_{CONN} = 2\frac{(1.6\times10^{-5}[\Omega\text{-mm}])(29[\text{mm}])}{282[\text{mm}^2]} = 3.3[\mu\Omega]. \tag{6}$$

It is useful also to estimate a contact resistance $R_{CONTACT}$ at each of the threaded fasteners 502. Using a commonly accepted formula for contact resistance, as reported by Hirpa L. Gelgele in "Study of Contact Area and Resistance in Contact Design of Tubing Connections", 13$^{th}$ International Research/Expert Conference, Trends in the Development of Machinery and Associated Technology, T M T 2009, Hammamet, Tunisia, October 2009, the contact resistance $R_{CONTACT}$ in Ohms for metallic surfaces that are free of insulating contaminants may be calculated from $$R_{CONTACT} = \rho\sqrt{\frac{\pi H_V}{4F}}, \tag{7}$$

where ρ is resistivity of the metal in Ohm-meters, His Vickers hardness of the softer of the two contacting materials in Pascals, and F is contact force in Newtons. For example, for copper $$\rho=1.6\times10^{-8}\ [\Omega\text{-m}];\ H_V=0.369\times10^{9}\ [\text{Pa}]\ (\text{copper}). \tag{8}$$

In a prototype of the first embodiment, fasteners 502 are M3 machine screws, for which an acceptable axial force is F=1500[N]. Substituting these values into equation (7) yields $$R_{CONTACT} = (1.6\times10^{-8}[\Omega\text{-}m])\sqrt{\frac{\pi\left(0.369\times10^{9}\left[\frac{N}{\text{m}^2}\right]\right)}{(4)(1500[N])}} = 7.0\ [\mu\Omega]\ (\text{one } M3 \text{ fastener}) \tag{9}$$

This is the contact resistance between a prototype of connector 100 and circuit board for a single fastener. Because, in board-to-board assembly 400, anode 106*a* is fastened to PCB 402 with six fasteners, the anode-to-board contact resistance will be one sixth of that stated in equation (9); that is, about 1.2 μΩ, assuming clean surfaces. The cathode-to-board contact resistance will likewise be about 1.2 μΩ. So the total contact resistance (anode and cathode) is about 2.4μΩ.

Figure 6:
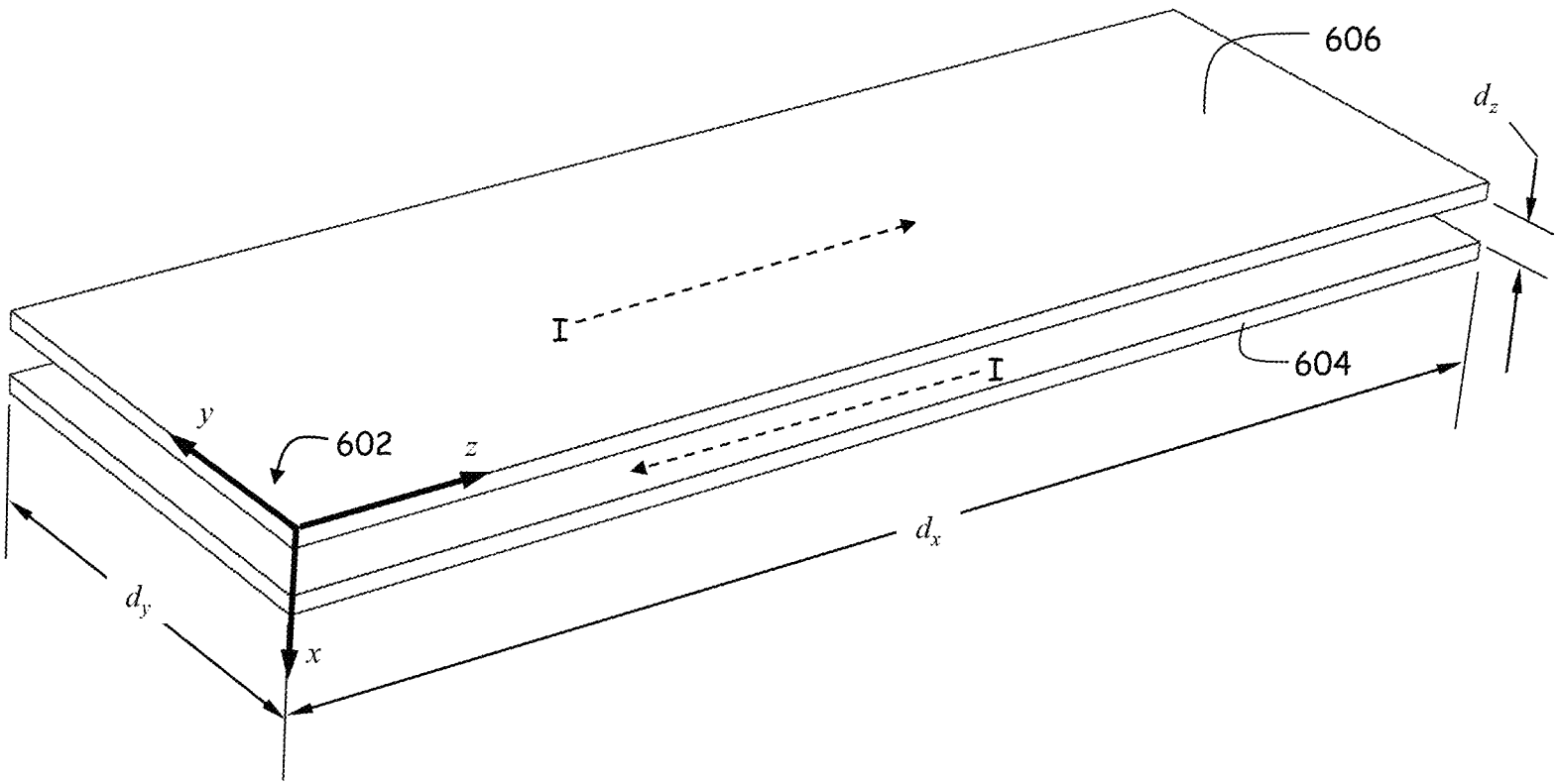
FIG. 6 illustrates parameters for computing self-inductance of two parallel plates.

A self-inductance $L_{CONN}$ of connector 100 may be computed using a well-known solution for the self-inductance of parallel plates. Referring to FIG. 6 and a coordinate system 602 thereon having an x direction, a y direction, and a z direction, all mutually orthogonal, thereby defining an xy plane, this solution states that, for a pair of parallel plates including a first parallel plate 604 and a second parallel plate 606 lying parallel to each other and parallel to the xy plane, each plate having dimensions $d_x$ and $d_y$ in the x and y directions respectively, with a gap between them of thickness $d_z$, the gap being filled with an insulating material having a magnetic permeability close to (i.e., within 10% of) the permeability of free space. Exemplary suitable insulating materials include plastics, Teflon, or air, but not ferrites.

$$\mu_0 = 4\pi \times 10^{-10}\left[\frac{H}{\text{mm}}\right], \tag{10}$$

and with electrical current I flowing toward the +x direction in plate 606 and toward the −x direction in plate 604, the self-inductance of the parallel plates is $$L_{PP} = \mu_0 \frac{d_x d_z}{d_y}. \tag{11}$$

Figure 7:
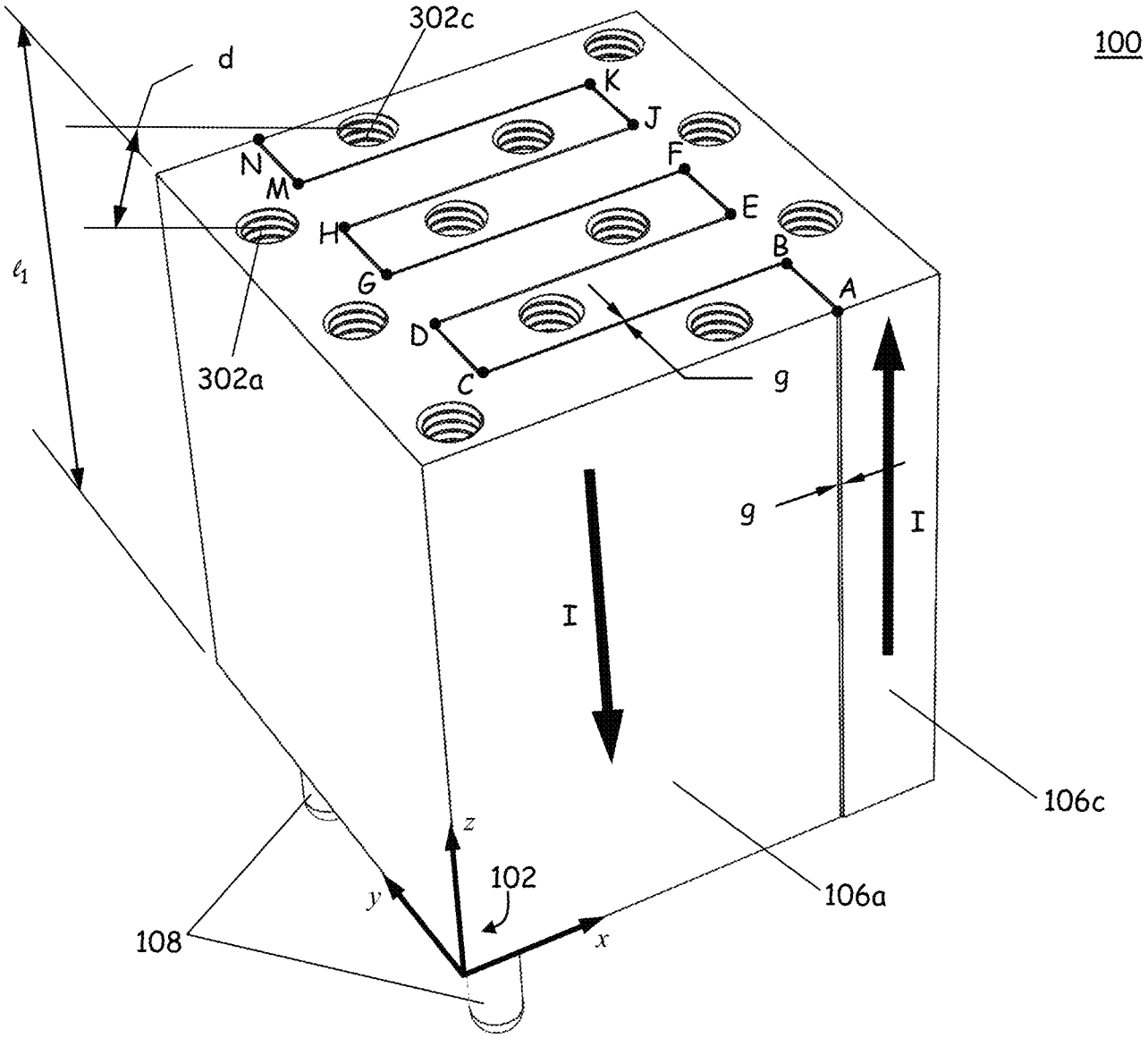
FIG. 7 illustrates parameters for computing self-inductance of the power connector of FIG. 1.

Referring to FIG. 7, let equation (11) be applied to connector 100, in which $$d_x = g;\ d_y = ABCDEFGHJKMN;\ d_z = \ell_1 \tag{12}$$

where ABCDEFGHJKMN means the length of the serpentine path along the interdigitated surfaces of the anode and cathode fingers. Consequently, the connector self-inductance is $$L_{CONN} = \mu_0 \frac{\ell_{1G}}{ABCDEFGHJKMN}. \tag{13}$$

For example, in the prototype version of connector 100, $$\ell_1 = 29\ [\text{mm}];\ g = 0.1\ [\text{mm}];\ ABCDEFGHJKMN = 100.8\ [\text{mm}]. \tag{14}$$

Consequently, for this prototype, the self-inductance of connector 100 is $$L_{CONN} = \mu_0 \frac{\ell_{1G}}{ABCDEFGHJKMN} = (4\pi \times 10^{-10})\frac{(29)(0.1)}{(100.8)} = 36.2[\text{pH}] \tag{15}$$

When the connector is deployed, as in FIG. 5, another inductance denoted $L_{INTO\ BOARD}$, which is in series with $L_{CONN}$, must be considered. $L_{INTO\ BOARD}$ involves current flow between connector 100 and PCB 402. Assume that such current can flow only in areas where anode 106*a* and cathode 106*c* are intimately in contact with PCB 402; this is not really true for high-frequency current, but assume pessimistically that it is true. Intimate contact typically occurs in the annular areas under the head of each fastener 502, assumed to have a head diameter 2a, because that is where large pressure is applied. Thus, referring to FIG. 7, there is an inductance associated with current I flowing out of PCB 402 into anode 106*a* in the vicinity of a hole 302*a* and flowing back into PCB 402 from cathode 106*c* in the vicinity of hole 302*c*. If the current flowing in these areas must penetrate into the board by a distance $\ell_2$ before reaching a power plane, then the inductance created by the hole-pair geometry (302*a* and 302*c*) is similar to that of two parallel wires, each of diameter 2a and length $\ell_2$, separated by a hole-to-hole distance d. The well-known inductance formula for this case is $$L_{HOLE\ PAIR} = \frac{\mu_0 \ell_2}{\pi}\left(\ln\frac{d}{a} + c\right), \tag{16}$$

where c=0 for high-frequency current, which shall be assumed. For the prototype connector 100 and its deployment with circuit board 402, $$2a = 5.5\ [\text{mm}];\ d = 8.3\ [\text{mm}];\ \ell_2 = 1\ [\text{mm}], \tag{17}$$

whence, for the prototype $$\begin{aligned} L_{HOLE\ PAIR} &= \frac{\mu_0 \ell_2}{\pi}\left(\ln\frac{d}{a} + c\right) \\ &= \frac{(4\pi \times 10^{-10}[H/\text{mm}])(1[\text{mm}])}{\pi}\ln\left(\frac{8.3[\text{mm}]}{2.75[\text{mm}]}\right) \\ &= 442[\text{pH}] \end{aligned} \tag{18}$$

Equation (18) would represent a fair estimate of $L_{INTO\ BOARD}$ if there were only one anode hole 302*a* and one cathode hole 302*c*. In fact, however, the plurality of anode holes 302*a* is interspersed with the plurality of cathode holes 302*c*. Consequently, $L_{INTO\ BOARD}$ is a fraction of $L_{HOLE\ PAIR}$. In general, calculation of $L_{INTO\ BOARD}$ is complex, because each anode hole has several neighboring cathode holes. However, pessimistically pairing each anode hole with only one cathode hole, an upper bound on $L_{INTO\ BOARD}$ may be estimated by regarding the hole pairs as equal inductances in parallel, and thus simply dividing $L_{HOLE\ PAIR}$ by the number N of hole pairs. That is, $$L_{INTO\ BOARD} \le \frac{L_{HOLE\ PAIR}}{N}. \tag{19}$$

For example, for the prototype, N=6, so, substituting (18) into (19), $$L_{INTO\ BOARD} \le \frac{442[\text{pH}]}{6} = 73.7[\text{pH}]. \tag{20}$$

Consequently, total inductance including $L_{INTO\ BOARD}$ is $$L_{TOTAL} = L_{CONN} + L_{INTO\ BOARD}, \tag{21}$$

and the nomenclature of the target specification given in (4) should be modified to $$L_{TOTAL} < 500\ [\text{pH}]. \tag{22}$$

For the prototype, substituting (15) and (20) into (21) yields $$L_{TOTAL} \le 36.2\ [\text{pH}] + 73.7\ [\text{pH}] \approx 110\ [\text{pH}], \tag{23}$$

which satisfies the target specification (22).

Figure 8:
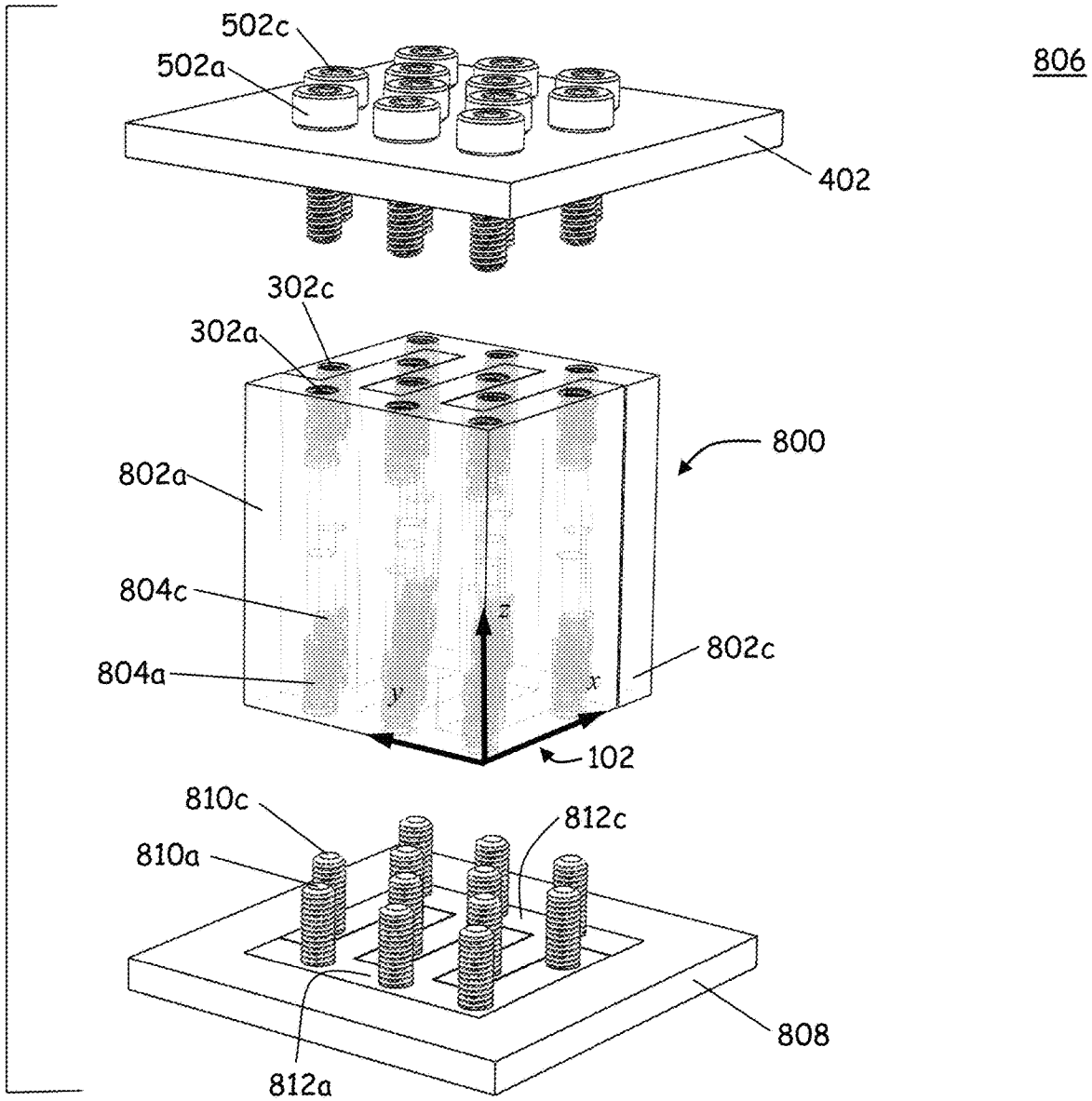
FIG. 8 illustrates an exploded view of a board-to-board assembly according to a second embodiment.

Description and Operation of a Second Embodiment (FIG. 8)

FIG. 8 illustrates, according to a second embodiment, a connector 800 that is similar to connector 100. Connector 800 includes two electrodes, an anode 802*a* and a cathode 802*c*, which are assembled in a manner identical to that described in connection with FIG. 2 in connection with electrodes 106*a* and 106*c*. The only difference between anode 802*a* of connector 800 and anode 106*a* of connector 100 is that, in anode 802*a*, the lower portion of each anode hole 302*a* has a threaded portion 804*a*. Likewise, the only difference between cathode 802*c* of connector 800 and cathode 106*c* of connector 100 is that, in cathode 802*c*, the lower portion of each cathode hole 302*c* has a threaded portion 804*c*. Consequently, locating pins 108 are not used in connector 800.

FIG. 8 further illustrates, in an exploded diagram analogous to FIG. 4, connector 800 deployed in a board-to-board assembly 806, which includes connector 800, PCB 402, anode fasteners 502*a* and cathode fasteners 502*c* for PCB 402, a PCB 808, a plurality of anode fasteners 810*a* for PCB 808, and a plurality of cathode fasteners 810*c* for PCB 808. The PCB 402 is fastened to the positive-z-facing surface of connector 800 as described for the first embodiment. In an exactly analogous fashion, PCB 808 is fastened to the negative-z-facing surface of connector 800. That is, a plurality of fasteners 810*a* engage threaded portions 804*a* to provide, when tightened, a low-resistance anode connection to a copper pad 812*a* printed upon board 808, pad 812*a* having a multi-finger shape that substantially matches the shape of anode 802*a*. Likewise, a plurality of fasteners 810*c* engage threaded portions 804*c* to provide, when tightened, a low-resistance cathode connection to a copper pad 812*c* printed upon board 808, pad 812*c* having a multi-finger shape that substantially matches the shape of cathode 802*c*.

The second embodiment is useful for applications in which a separable connection is desired between the connector 800 and both of the sandwiching PCBs.

Electrical operation of the second embodiment is similar to the first embodiment, except that there is additional contact resistance and inductance associated with the additional threaded connection of PCB 808 to connector 800. For example in the prototype, the additional threaded connection will cause about 2.4 μΩ of additional resistance, as calculated for the first embodiment following equation (9), and will cause about 73.7 pH of additional inductance, raising the upper bound on $L_{TOTAL}$ to $$L_{TOTAL} \leq L_{CONN} + 2L_{INTO\ BOARD} = 183.6\ [\text{pH}] \tag{24}$$

according to equations (15) and (20).

Figure 9:
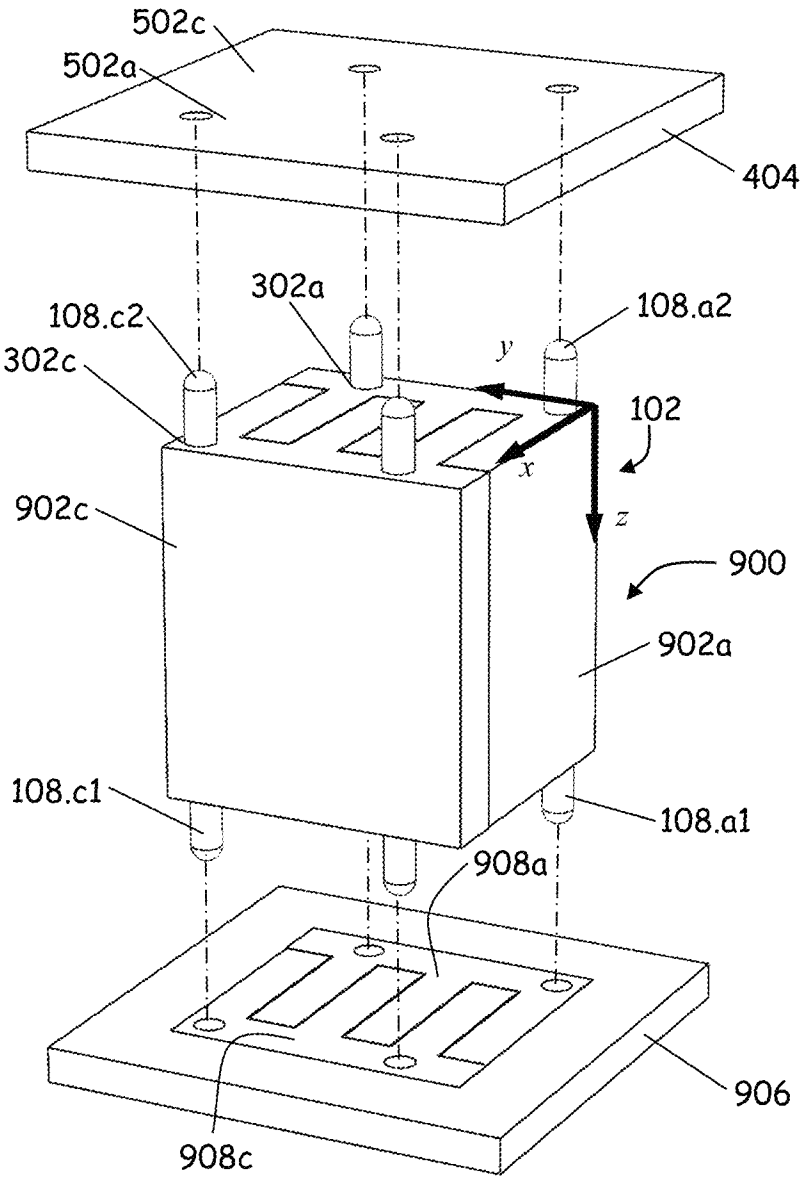
FIG. 9 illustrates an exploded view of a board-to-board assembly according to a third embodiment.

Description and Operation of a Third Embodiment (FIG. 9)

FIG. 9 illustrates, according to a third embodiment, a connector 900 that is similar to connector 100. Connector 900 includes two electrodes, an anode 902*a* and a cathode 902*c*, which are assembled in a manner identical to that described in connection with FIG. 2 in connection with electrodes 106*a* and 106*c*. The difference between anode 902*a* of connector 800 and anode 106*a* of connector 100 is that anode 902*a* has only two holes 302*a*, both of which are unthreaded on both ends, and each of which is populated with an instance of locating pin 108 denoted 108.*a*1 that protrudes from the positive-z-facing surface of anode 902*a*, as well as an instance of locating pin 108 denoted 108.*a*2 that protrudes from the negative-z-facing surface of anode 902*a*. Likewise, the difference between cathode 902*c* of connector 800 and cathode 106*c* of connector 100 is that cathode 902*c* has only two holes 302*c*, both of which are unthreaded on both ends, and each of which is populated with an instance of locating pin 108 denoted 108.*c*1 that protrudes from the positive-z-facing surface of cathode 902*c*, as well as an instance of locating pin 108 denoted 108.*c*2 that protrudes from the negative-z-facing surface of cathode 902*c*.

FIG. 9 further illustrates, in an upside-down exploded diagram analogous to FIG. 5, connector 900 deployed in a board-to-board assembly 906 that includes connector 900, PCB 404, and a PCB 906. Referring to the upside-down coordinate system on FIG. 9, PCB 404 is attached to the negative-z-facing surface of connector 900 with solder, as described in the first embodiment, to achieve low-resistance connections of anode 902*a* and cathode 902*c* to copper pads 506*a* and 506*c* respectively, these pads being not visible on FIG. 9, but visible on FIG. 5. Likewise, PCB 906 is attached to the positive-z-facing surface of connector 900 with solder, to achieve low-resistance connections of anode 902*a* and cathode 902*c* to copper pads 908*a* and 908*c* respectively, these pads being printed on the negative-z-facing surface of PCB 906.

The third embodiment is useful for applications in which a permanent, soldered connection is desired between the connector 800 and both of the sandwiching PCBs. Electrical operation of the third embodiment is similar to the first embodiment, except that the contact resistance and inductance associated with the threaded connection to PCB 402 in the first embodiment is eliminated by the soldered connection of PCB 906 in the second embodiment. For example in the prototype, removing the threaded connection reduces resistance by cause about 2.4 μΩ and reduces inductance by about 73.7 pH, thereby lowering the inductance upper bound to $$L_{TOTAL} \leq L_{CONN} = 36.2\ [\text{pH}]. \tag{25}$$

Description and Operation of a Fourth Embodiment (FIGS. 10-14 and 15*a*-15*f*)

Figure 10:
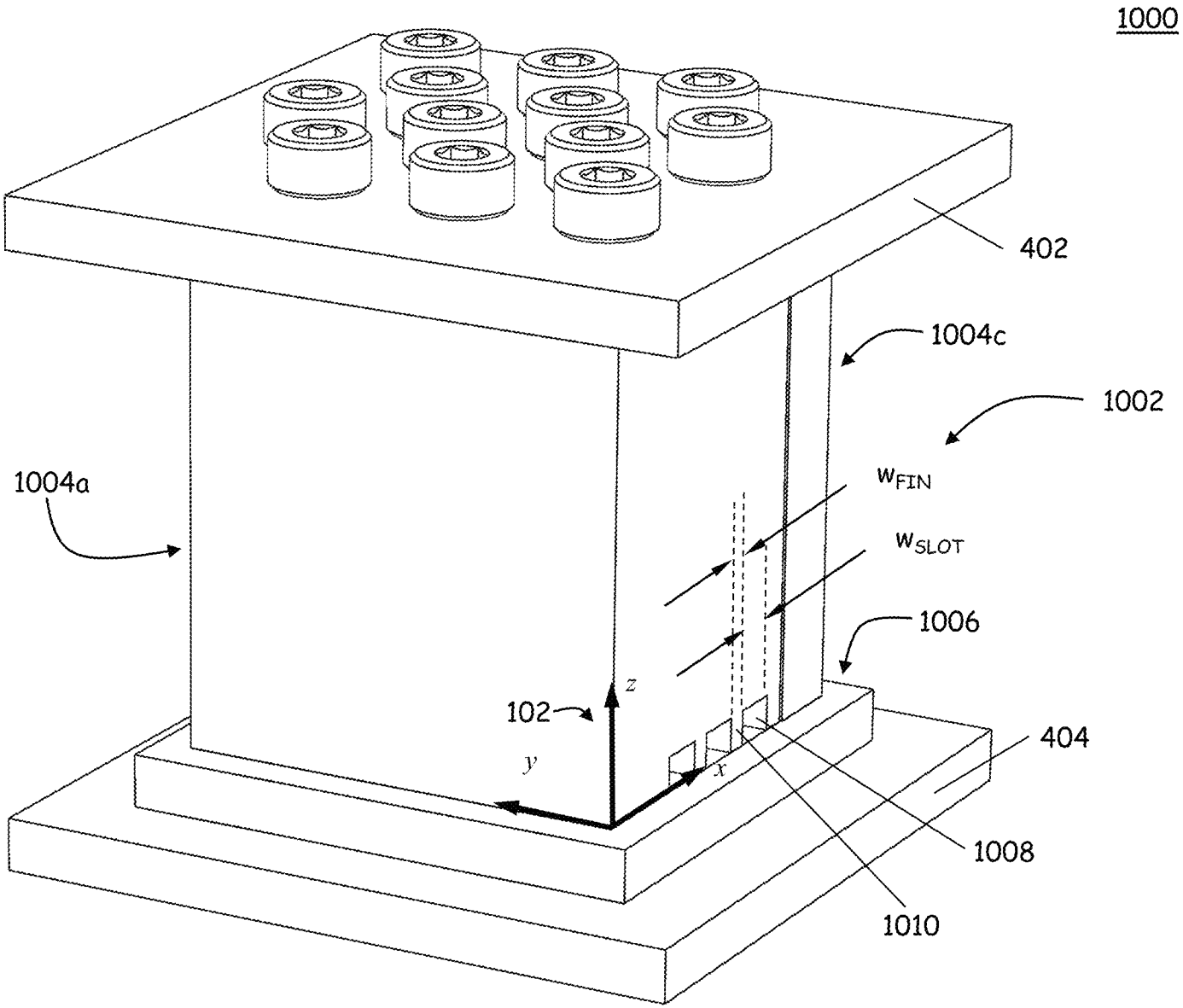
FIG. 10 illustrates an assembled view of a board-to-board assembly according to a fourth embodiment.
Figure 11:
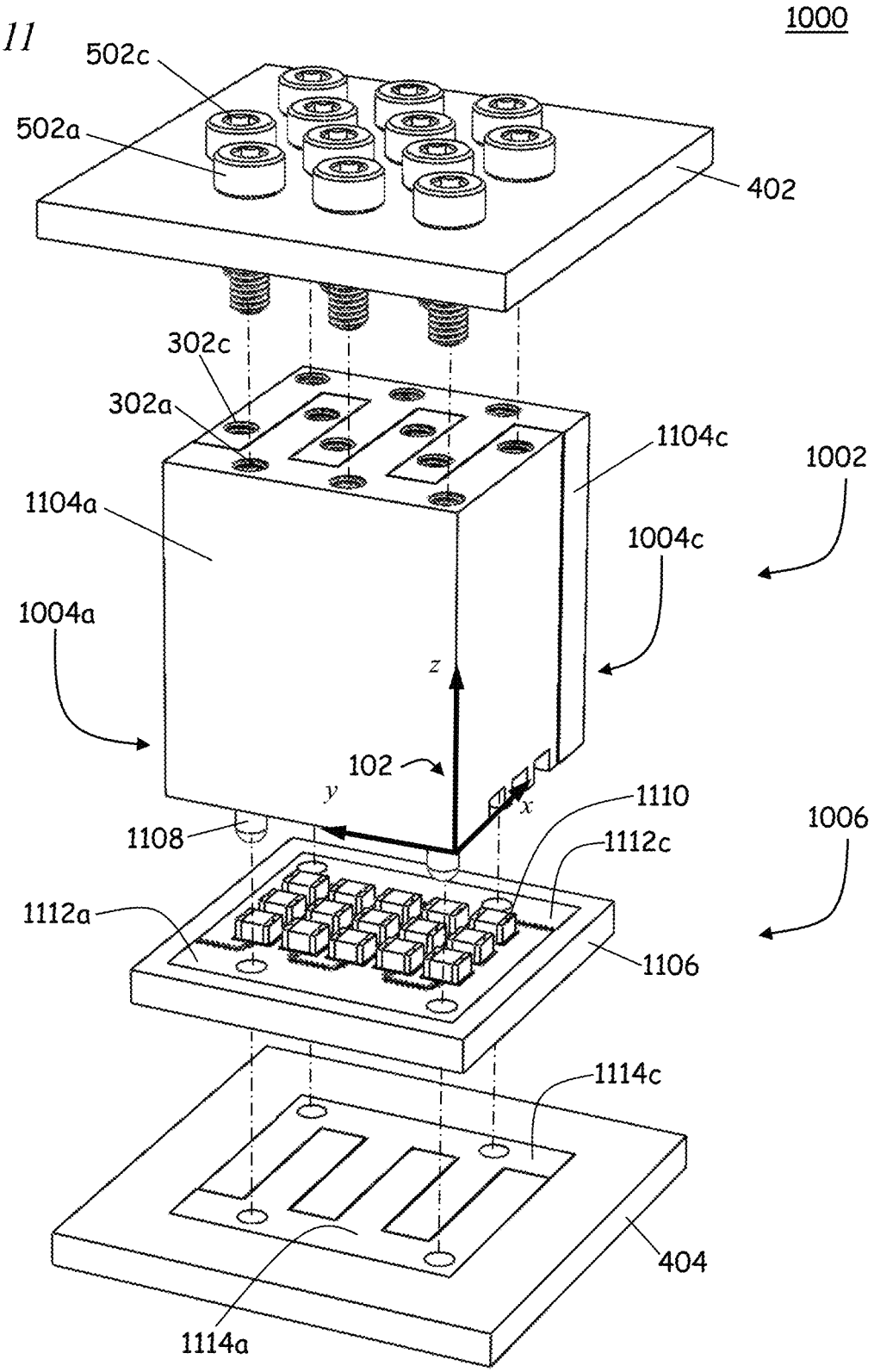
FIG. 11 illustrates an exploded view of the board-to-board assembly of FIG. 10.

FIG. 10 and FIG. 11 illustrate, according to a fourth embodiment, a power connector 1002, shown in the context of a board-to-board assembly 1000 that includes, in addition to power connector 1002, an interposer assembly 1006, the first PCB 402 on which voltage $V_1$ is generated, and the second PCB 404 where voltage $V_1$ is used to power various electronic devices. Power connector 1002 includes an anode assembly 1004*a* and an identical cathode assembly 1004*c*. Board-to-board assembly 1000 is shown assembled on FIG. 10 and exploded on FIG. 11.

Referring to FIG. 11, anode assembly 1004*a* includes an anode 1104*a* and two locating pins 1108 that protrude from the negative-z-facing surface thereof to locate it to the interposer assembly 1006; likewise, cathode assembly 1004*c* includes a cathode 1104*c* and two additional locating pins 1108 (not visible on FIG. 11). Anode 1104*a* has, on the positive-z-facing surface thereof, a plurality of threaded holes 302*a* for the attachment of PCB 402 using threaded fasteners 502*a* as previously described for the first embodiment. Likewise, cathode 1104*c* has, on the positive-z-facing surface thereof, a plurality of threaded holes 302*c* for the attachment of PCB 402 using fasteners 502*c*. Defining $N_S$ is an integer greater than zero and referring to FIG. 10, anode 1104*a* and cathode 1104*c* each also have, cut into the negative-z-facing surface thereof, $N_S$ slots 1008, each of width $w_{SLOT}$. Slots 1008 create $N_S$ fins 1010, each of width $w_{FIN}$.

Figure 14:
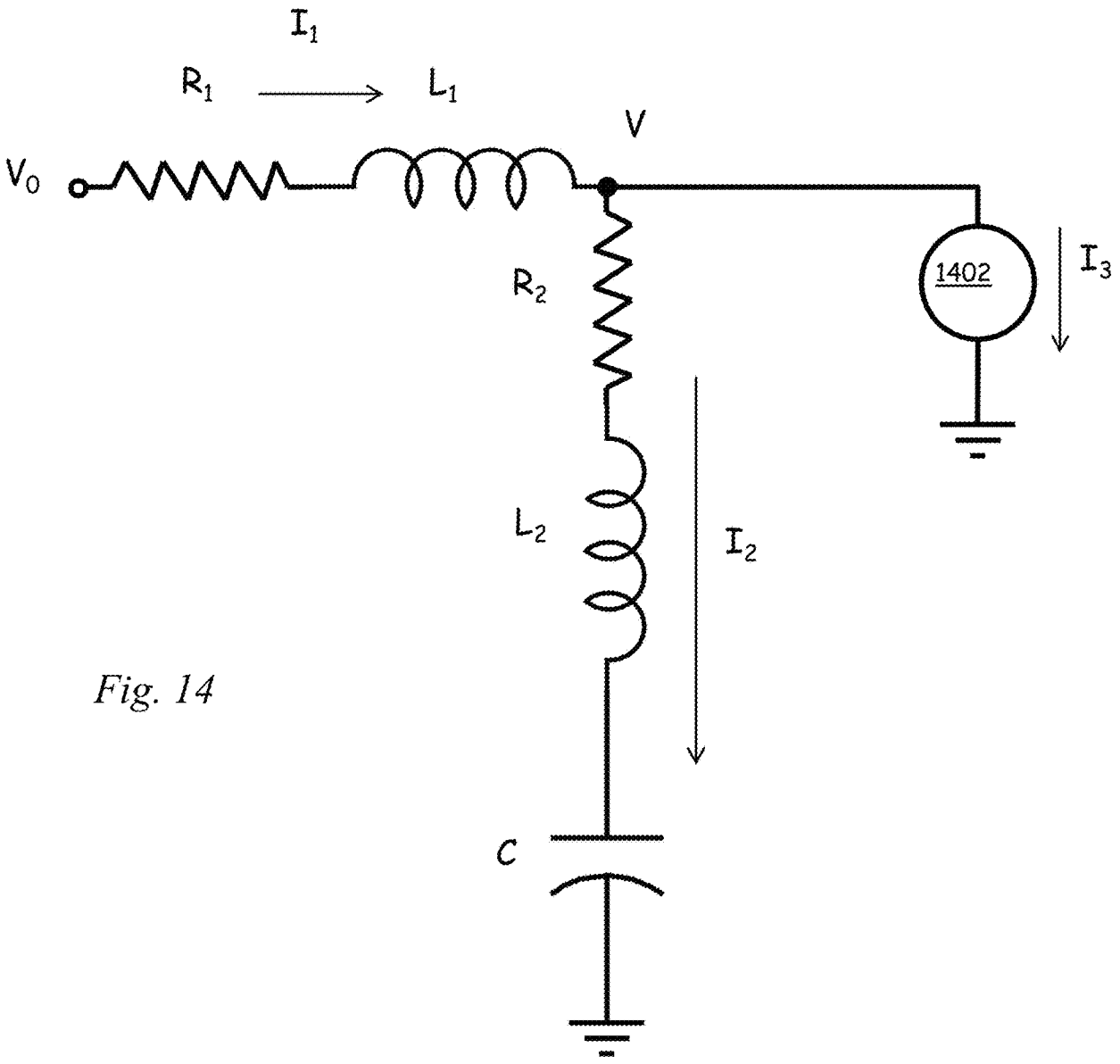
FIG. 14 illustrates an electrical schematic diagram of a model of the board-to-board assembly of FIG. 10.

Interposer assembly 1006 includes an interposer circuit board 1106, also known as "interposer 1106", and a plurality of capacitors 1110 soldered thereto. Capacitors 1110 are accommodated by slots 1008. Anode 1104*a* is affixed with solder to a copper pad 1112*a* that is printed upon the positive-z-facing surface of interposer 1106. Likewise, cathode 1104*c* is affixed with solder to a copper pad 1112*c*. Interposer 1106 is affixed to PCB 404 using copper pads printed upon the negative-z-facing surface thereof, which are soldered to similarly shaped pads 1114*a* and 1114*c* printed upon the positive-z-facing surface of PCB 404. An electronic load 1404, not shown in FIG. 11, but shown schematically in FIG. 14, is connected to PCB 404.

Figure 12:
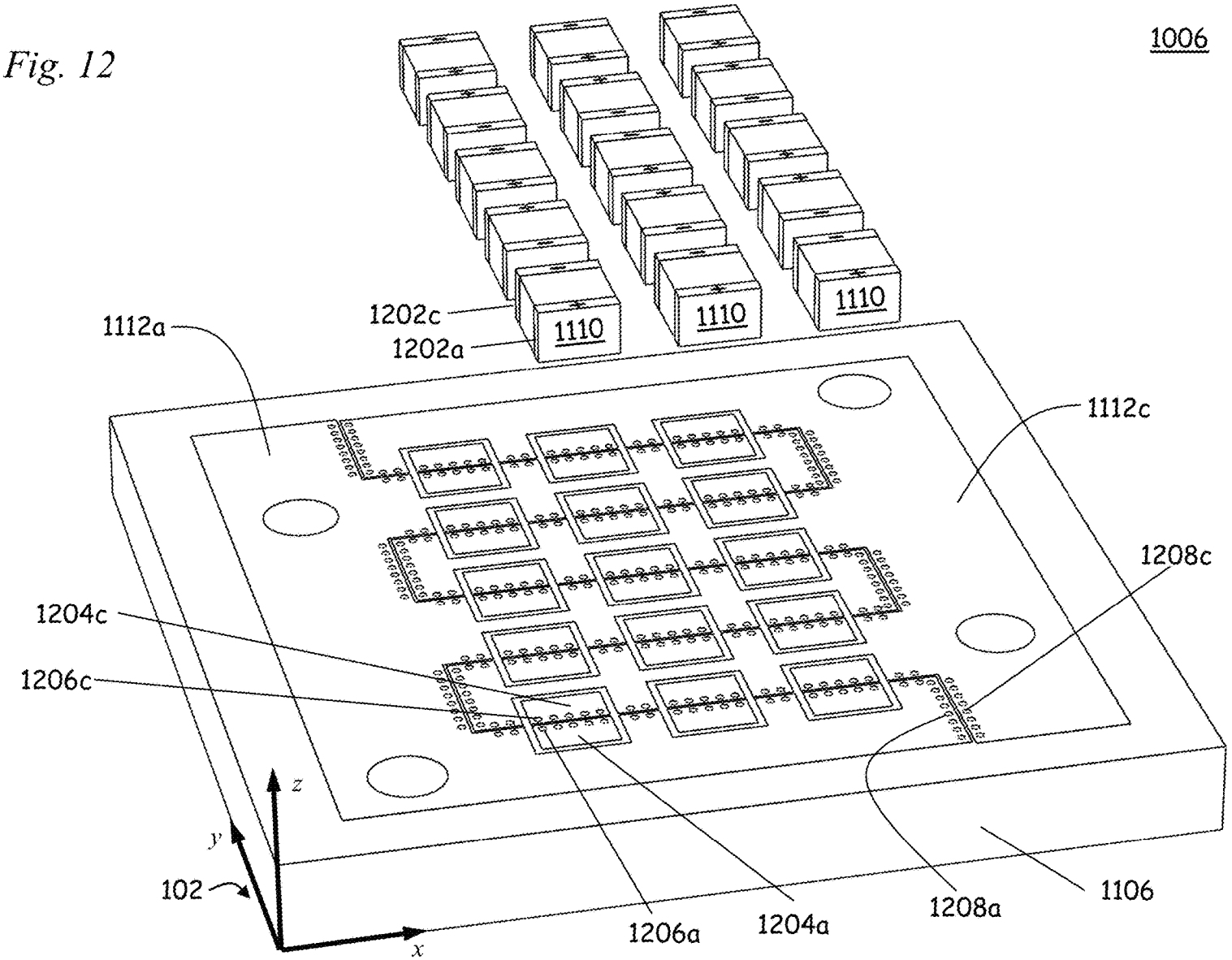
FIG. 12 illustrates an exploded view of an interposer assembly of the board-to-board assembly of FIG. 10.

FIG. 12 illustrates an exploded view of interposer assembly 1006. Each capacitor 1110 includes a first terminal 1202*a* labeled "+" on FIG. 12, and a second terminal 1202*c* labeled "-" on FIG. 12. For each capacitor, first terminal 1202*a* is soldered to a first copper capacitor pad 1204*a* printed upon the positive-z-facing surface of interposer 1106. Likewise, for each capacitor, second terminal 1202*c* is soldered to a second copper capacitor pad 1204*c* printed upon the positive-z-facing surface of interposer 1106. Capacitor pads 1204*a* are electrically connected to a bottom anode pad (not shown) located on the negative-z-facing surface of interposer 1106 that overlays and is soldered to copper pad 1114*a* (shown on FIG. 11) on the positive-z-facing surface of PCB 404. Likewise, capacitor pads 1204*c* are electrically connected, within the internal structure of the interposer, to a bottom cathode pad (not shown) located on the negative-z-facing surface of interposer 1106 that overlays and is soldered to copper pad 1114*c* (shown on FIG. 11) on the positive-z-facing surface of PCB 404. Thus, because capacitor pads 1204*a* and 1204*c* are electrically connected to pads 1114*a* and 1114*c* respectively, all capacitors 1110 are connected electrically in parallel across anode and cathode.

Still referring to FIG. 12, a plurality of anode capacitor vias 1206*a* connects each capacitor pad 1204*a* to the bottom anode pad (not shown) on the negative-z-facing surface of interposer 1106, and thence to pad 1114*a* on PCB 404. Likewise, a plurality of cathode capacitor vias 1206*c* connects each capacitor pad 1204*c* to the bottom cathode pad (not shown) on the negative-z-facing surface of interposer 1106, and thence to pad 1114*c* on PCB 404. Each of the anode capacitor vias 1206*a* is near to a corresponding cathode capacitor via 1206*c* in order to provide low anode-to-cathode inductance for current flow through the capacitor vias. Applying formula (16) with typical values $\ell_2$=0.5 mm, a=0.125 mm, d=0.75 mm, c=0 yields $L_{HOLE\ PAIR}$=358 pH. For the case shown, the number of hole pairs is N=75, so, invoking equation (19), the inductance into the interposer board through the capacitor vias is 4.77 pH.

Similarly, still referring to FIG. 12, a plurality of anode stitch vias 1208*a* connects anode pad 1112*a* on the positive-z-facing surface of interposer 1106 to the bottom anode pad (not shown) on the negative-z-facing surface thereof, and thence to pad 1114*a* on PCB 404 (FIG. 11). Likewise, a plurality of cathode stitch vias 1208*c* connects cathode pad 1112*a* on the positive-z-facing surface of interposer 1106 to the bottom cathode pad (not shown) on the negative-z-facing surface thereof, and thence to pad 1114*c* (FIG. 11). Each of the anode stitch vias 1208*a* is near to a corresponding cathode stitch via 1208*c* in order to provide low anode-to-cathode inductance for current flow through the stitch vias. Applying formula (16) with values as in the previous paragraph except N=88 (the number of stitch via pairs shown in FIG. 12), the inductance into the interposer board through the stitch vias is 4.07 pH.

Figure 13:
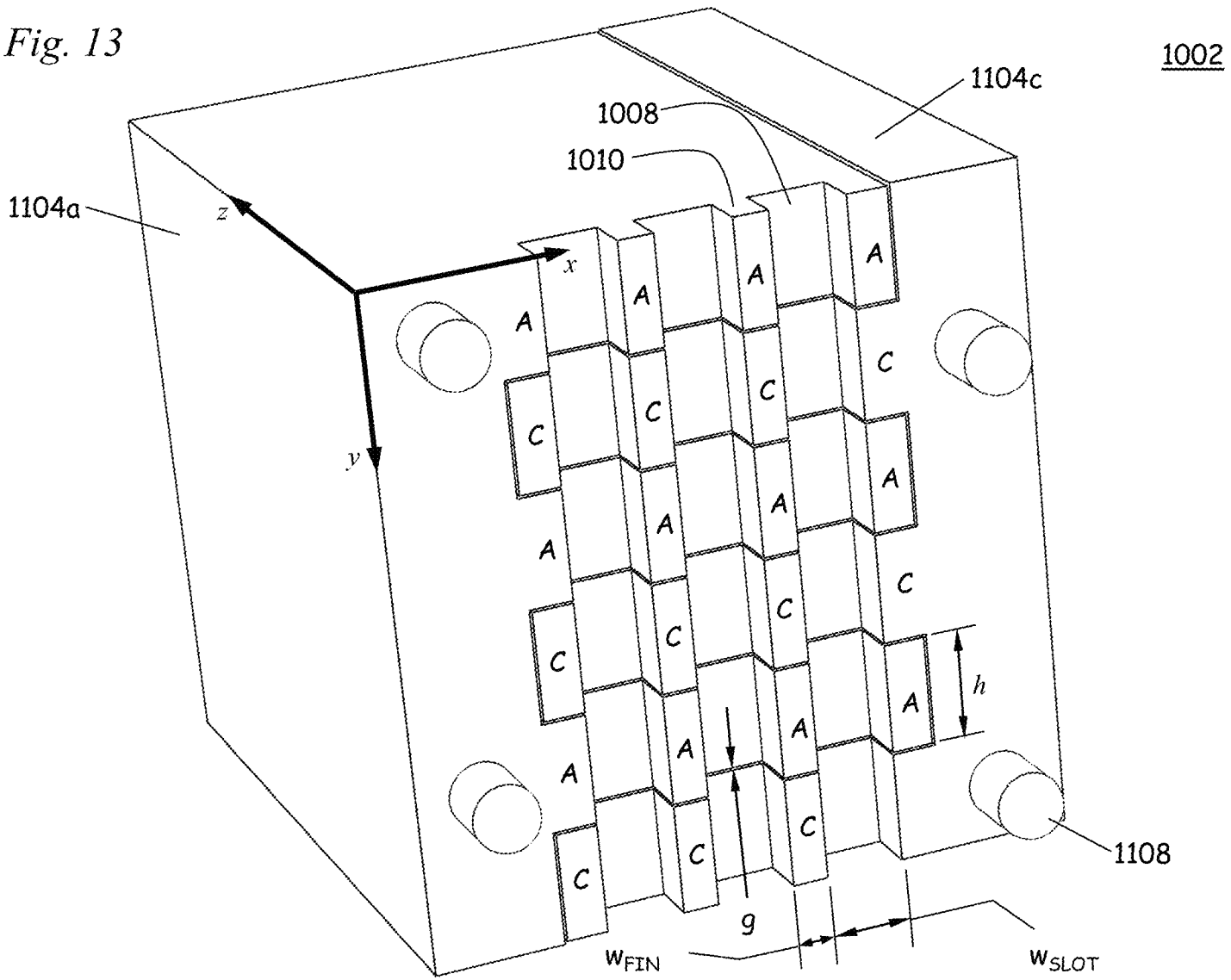
FIG. 13 illustrates a bottom perspective view of a connector assembly of the board-to-board assembly of FIG. 10.

FIG. 13 illustrates a bottom-perspective view of the power connector 1002. As previously mentioned in connection with FIG. 10, the negative-z-facing surface of each electrode is partially cut away to accommodate capacitor 1110, thereby producing an integer number $N_S$ of slots 1008 and fins 1010. For the case shown in FIG. 13, $N_S$=3. Referring to FIG. 13 as well as FIG. 11, anode portions A of the negative-z-facing surface of anode 1104*a*, each having dimensions $w_{FIN}$×h, are soldered to copper pad 1114*a* on PCB 404. Likewise cathode portions C of the negative-z-facing surface of cathode 1104*c*, each having dimensions $w_{FIN}$×h, are soldered to copper pad 1114*c* on PCB 404.

Referring to the particular case shown on FIG. 13, an inductance $L_4$ associated with current flowing through surfaces A and C into the PCB 404, is estimated by application of equation (11) with $d_x$=Distance normal to surface of PCB 404, from soldered surfaces to the power plane.

$$d_z=g$$

$$d_y=6h+20w_{FIN} \tag{26}$$

where, referring to FIG. 13, g is the anode-to-cathode gap, and each fin has dimensions $w_{FIN}$×h. Thus $$L_4=\mu_0\frac{d_x g}{6h+20w_{FIN}}. \tag{27}$$

For the prototype, $$d_x=1.0\ [\text{mm}];\ g=0.1\ [\text{mm}];\ h=4.2\ [\text{mm}];\ w_{FIN}=1.4\ [\text{mm}], \tag{28}$$

whence, for the prototype $$L_4=\left(4\pi\times10^{-10}\left[\frac{H}{\text{mm}}\right]\right)\frac{(1.0[\text{mm}])(0.1[\text{mm}])}{6(4.2[\text{mm}])+20(1.4[\text{mm}])}=2.4[\text{pH}]. \tag{29}$$

In the fourth embodiment, the purpose of the interposer assembly is, by virtue of capacitors 1110, to provide a capacitance C that counteracts the deleterious effects of an inductance $L_1$ associated with current flow between the power supply on PCBs 402 and the electronics on PCB 404 through board-to-board assembly 1000. Because a number N of capacitors 1110 are provided in parallel, each with a capacitance $C_0$, capacitance C is given by $$C=NC_0 \tag{30}$$

To understand the effect of capacitance C, consider FIG. 14, which is an electrical schematic diagram of board-to-board assembly 1000. The diagram illustrates not only capacitance C of capacitors 1110, but also the equivalent series resistance and equivalent series inductance thereof, denoted $R_2$ and $L_2$ respectively. The power supply has an equivalent resistance $R_1$. In series with $R_1$ is an inductance $L_1$ that represents the total inductance of the path from power supply to capacitors 1110. The electronic load 1402 consumes a time-variable current $I_3$. Because of this time-varying current demand from load 1402, circuit elements $R_1$, $L_1$, C, $R_2$, and $L_2$ cause a voltage V, which is delivered to load 1402, to differ from a constant, power-supply voltage level $V_0$.

Let $$I_1 \equiv \text{Time-varying current through } L_1 \text{ and } R_1 \tag{31}$$

$$I_2 \equiv \text{Time-varying current through } L_2, R_2, \text{ and } C \tag{32}$$

$$I_3 \equiv \text{Time-varying current through load 1402} \tag{33}$$

We seek to determine how the voltage V responds to a sinusoidal oscillation of the load current $I_3$. In particular, the purpose of the ensuing analysis is to demonstrate that capacitors 1110, which provide capacitance C, keep the voltage V closer to the ideal value $V_0$ than would occur if capacitors 1110 were absent.

By conservation of current $$I_1 = I_2 + I_3. \tag{34}$$

Consequently, $$\dot{I}_1 = \dot{I}_2 + \dot{I}_3, \tag{35}$$

where a dot represents a first derivative with respect to time t, for example $$\dot{I}_1 \equiv \frac{dI_1}{dt}. \tag{36}$$

Moreover, $$\ddot{I}_1 = \ddot{I}_2 + \ddot{I}_3, \tag{37}$$

where a double-dot represents a second derivative with respect to time, for example $$\ddot{I}_1 \equiv \frac{d^2 I_1}{dt^2}. \tag{38}$$

By the definition of resistance, inductance and capacitance, inspection of FIG. 16 yields $$V_0 - V = R_1 I_1 + L_1 \dot{I}_1 \text{ and} \tag{39}$$

$$V = R_2 I_2 + L_2 \dot{I}_2 + \frac{1}{C}\int I_2 dt. \tag{40}$$

Differentiating equations (39) and (40) gives $$-\dot{V} = R_1 \dot{I}_1 + L_1 \ddot{I}_1 \tag{41}$$

$$\dot{V} = R_2 \dot{I}_2 + L_2 \ddot{I}_2 + \frac{I_2}{C} \tag{42}$$

Comparing equations (41) and (42) yields $$R_2 \dot{I}_2 + L_2 \ddot{I}_2 + \frac{I_2}{C} = -(R_1 \dot{I}_1 + L_1 \ddot{I}_1). \tag{43}$$

Substituting equations (35) and (37) into equation (43) to eliminate $I_1$ in favor of $I_2$ yields $$R_2 \dot{I}_2 + L_2 \ddot{I}_2 + \frac{I_2}{C} = -[R_1(\dot{I}_2 + \dot{I}_3) + L_1(\ddot{I}_2 + \ddot{I}_3)]. \tag{44}$$

Rearranging equation (44) produces $$(L_1 + L_2)\ddot{I}_2 + (R_1 + R_2)\dot{I}_2 + \frac{I_2}{C} = -[R_1 \dot{I}_3 + L_1 \ddot{I}_3]. \tag{45}$$

In accordance with normal practice, define an undamped natural frequency $\omega_0$ of the system as $$\omega_0 \equiv \frac{1}{\sqrt{(L_1 + L_2)C}}, \tag{46}$$

and define a damping ratio $\zeta$ by $$2\zeta\omega_0 \equiv \frac{R_1 + R_2}{L_1 + L_2}. \tag{47}$$

Then equation (45) may be written as $$\ddot{I}_2 + 2\zeta\omega_0 \dot{I}_2 + \omega_0^2 I_2 = -[\alpha \dot{I}_3 + \beta \ddot{I}_3] \tag{48}$$

where, for brevity, $\alpha$ and $\beta$ are defined as $$\alpha \equiv \frac{R_1}{L_1 + L_2}; \beta \equiv \frac{L_1}{L_1 + L_2}. \tag{49}$$

Assume that the current demanded by load 1104 oscillates sinusoidally about a constant, nominal value $I_{30}$, the oscillation having an amplitude $\Delta I_3$ and a circular frequency $\omega$:

$$I_3(t) = I_{30} + \Delta I_3 \sin \omega t. \tag{50}$$

Assume the response $$I_2(t) = A \sin \omega t + B \cos \omega t, \tag{51}$$

where the constants A and B are to be determined. Substitution of equations (50) and (51) into equation (48) produces $$-A\omega^2 \sin\omega t - \beta w^2 \cos\omega t + 2\zeta\omega_0(A\omega\cos\omega t - \beta w \sin\omega t) + \omega_0^2(A\sin\omega t + B\cos\omega t) = -[\alpha\Delta I_3 \omega\cos\omega t - \beta\Delta I_3 \omega^2 \sin\omega t]. \tag{52}$$

Separating the sin $\omega$t and cos cot components in equation (52) yields:

$$\sin \omega t\text{: } -A\omega^2 - 2\zeta\omega_0\omega B + A\omega_0^2 = \beta\Delta I_3 \omega^2 \tag{53}$$

$$\cos \omega t\text{: } -B\omega^2 + 2\zeta\omega_0\omega A + B\omega_0^2 = -\alpha\Delta I_3 \omega \tag{54}$$

Grouping terms in equations (53) and (54):

$$\sin \omega t\text{: } -(\omega^2 - \omega_0^2)A - 2\zeta\omega_0\omega B = \beta\Delta I_3 \omega^2 \tag{55}$$

$$\cos \omega t\text{: } 2\zeta\omega_0\omega A - (\omega^2 - \omega_0^2)B = -\alpha\Delta I_3 \omega \tag{56}$$

By Cramer's Rule $$A = \frac{\begin{vmatrix} \beta\Delta I_3\omega^2 & -2\zeta\omega_0\omega \\ -\alpha\Delta I_3\omega & -(\omega^2-\omega_0^2) \end{vmatrix}}{\begin{vmatrix} -(\omega^2-\omega_0^2) & -2\zeta\omega_0\omega \\ 2\zeta\omega_0\omega & -(\omega^2-\omega_0^2) \end{vmatrix}} = \frac{-\omega^2(\omega^2-\omega_0^2)\beta - 2\zeta\omega_0\omega^2\alpha}{(\omega^2-\omega_0^2)^2+(2\zeta\omega_0\omega)^2}\Delta I_3 \tag{57}$$

$$B = \frac{\begin{vmatrix} -(\omega^2-\omega_0^2) & \beta\Delta I_3\omega^2 \\ 2\zeta\omega_0\omega & -\alpha\Delta I_3\omega \end{vmatrix}}{\begin{vmatrix} -(\omega^2-\omega_0^2) & -2\zeta\omega_0\omega \\ 2\zeta\omega_0\omega & -(\omega^2-\omega_0^2) \end{vmatrix}} = \frac{\omega(\omega^2-\omega_0^2)\alpha - 2\zeta\omega_0\omega^3\beta}{(\omega^2-\omega_0^2)^2+(2\zeta\omega_0\omega)^2}\Delta I_3 \tag{58}$$

Recall that the purpose of this analysis is to compute the magnitude of the oscillation in V, and to show that capacitance C makes it smaller than it would be if C were zero. For this purpose, substitute equation (51) and its derivatives into equation (42). The various derivatives of $I_2$ are $$I_2 = A\sin\omega t + B\cos\omega t \tag{59}$$

$$\dot{I}_2 = A\omega\cos\omega t - B\omega\sin\omega t \tag{60}$$

$$\ddot{I}_2 = -\Delta\omega^2\sin\omega t - B\omega^2\cos\omega t. \tag{61}$$

Substituting into equation (42) and grouping terms:

$$\dot{V}(t) = \sin\omega t\left[-A\omega^2 L_2 - B\omega R_2 + \frac{A}{C}\right] + \cos\omega t\left[-B\omega^2 L_2 + A\omega R_2 + \frac{B}{C}\right]. \tag{62}$$

Integrating to obtain V(t) produces $$V(t) = \cos\omega t\left[A\omega L_2 + BR_2 - \frac{A}{\omega C}\right] + \sin\omega t\left[-B\omega L_2 + AR_2 + \frac{B}{\omega C}\right] + D, \tag{63}$$

where D is an integration constant, which is determined by considering the ideal condition when $\Delta I_3=0$. According to equations (57) and (58), A=B=0 when $\Delta I_3=0$, and moreover $\dot{I}_1=0$ according to equation (50), so in ideal conditions, according to equation (39), $$V = V_0 - I_1R_1 = V_0 - I_{30}R_1 \text{(ideal conditions, } \Delta I_3=0,\ A=B=0) \tag{64}$$

Consequently, the integration constant D in equation (63) is $$D = V_0 - I_{30}R_1, \tag{65}$$

and equation (63) may be rewritten as $$\Delta V(t) \equiv V(t) - (V_0 - I_{30}R_1) = \cos\omega t\left[A\omega L_2 + BR_2 - \frac{A}{\omega C}\right] + \sin\omega t\left[-B\omega L_2 + AR_2 + \frac{B}{\omega C}\right], \tag{66}$$

where equation (66) defines ΔV (t) as the difference between V Wand its ideal value.

Thus, summing the squares of the components in equation (66), the magnitude of the oscillation in ΔV (t) is $$|\Delta V(t)| = \sqrt{\left[A\omega L_2 + BR_2 - \frac{A}{\omega C}\right]^2 + \left[-B\omega L_2 + AR_2 + \frac{B}{\omega C}\right]^2}. \tag{67}$$

The magnitude of this oscillation may be investigated numerically for various values of the parameters.

Figure 15A:
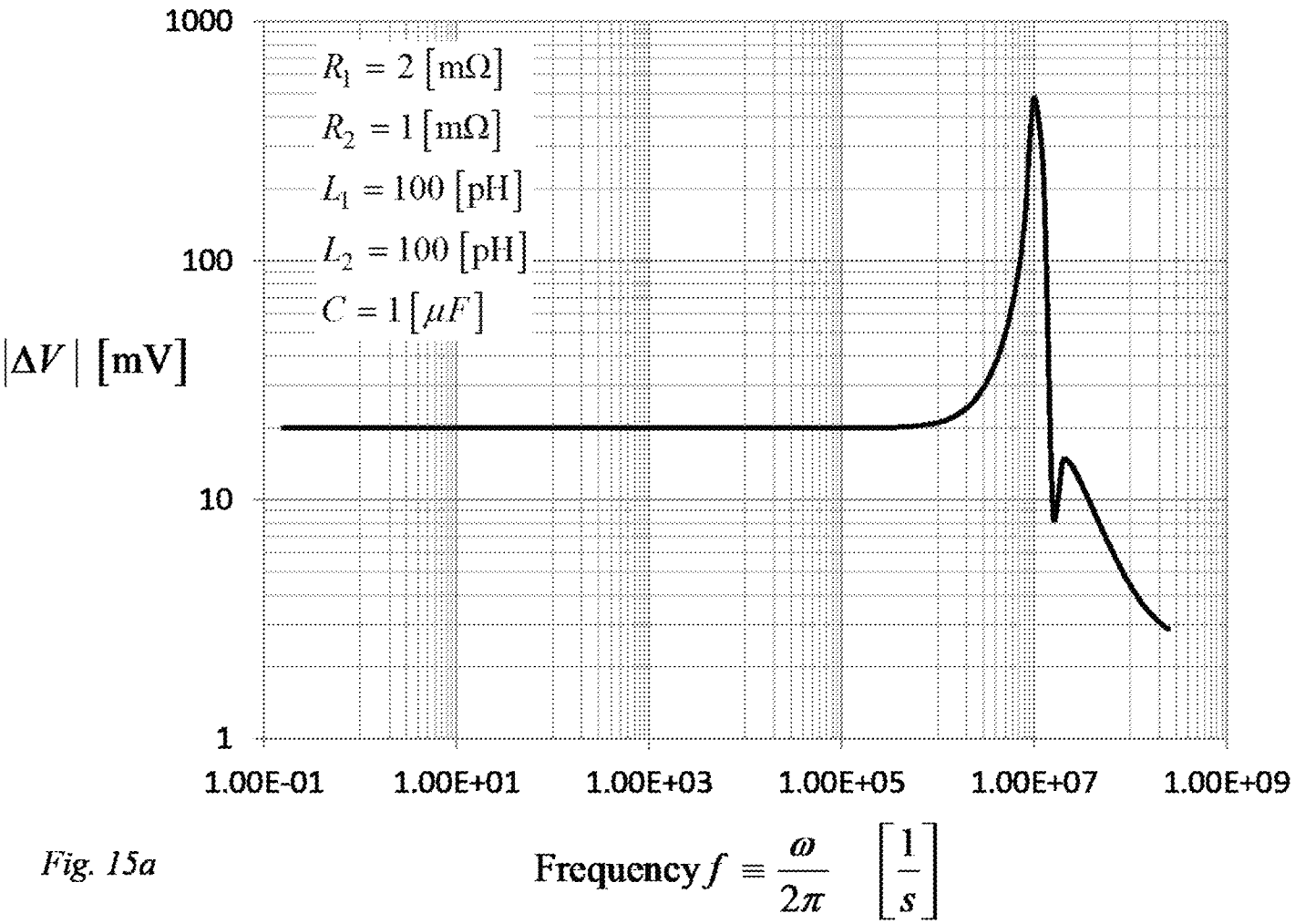
FIG. 15*a* illustrates frequency response of the model of FIG. 14 for capacitance C=1 μF.

For example, FIGS. 15*a* through 15*f* illustrate plots of |ΔV| versus frequency $$f \equiv \frac{\omega}{2\pi} \tag{68}$$

for various values of the capacitance C. Specifically:

On FIG. 15*a*: $C$=1 [μF]

Figure 15B:
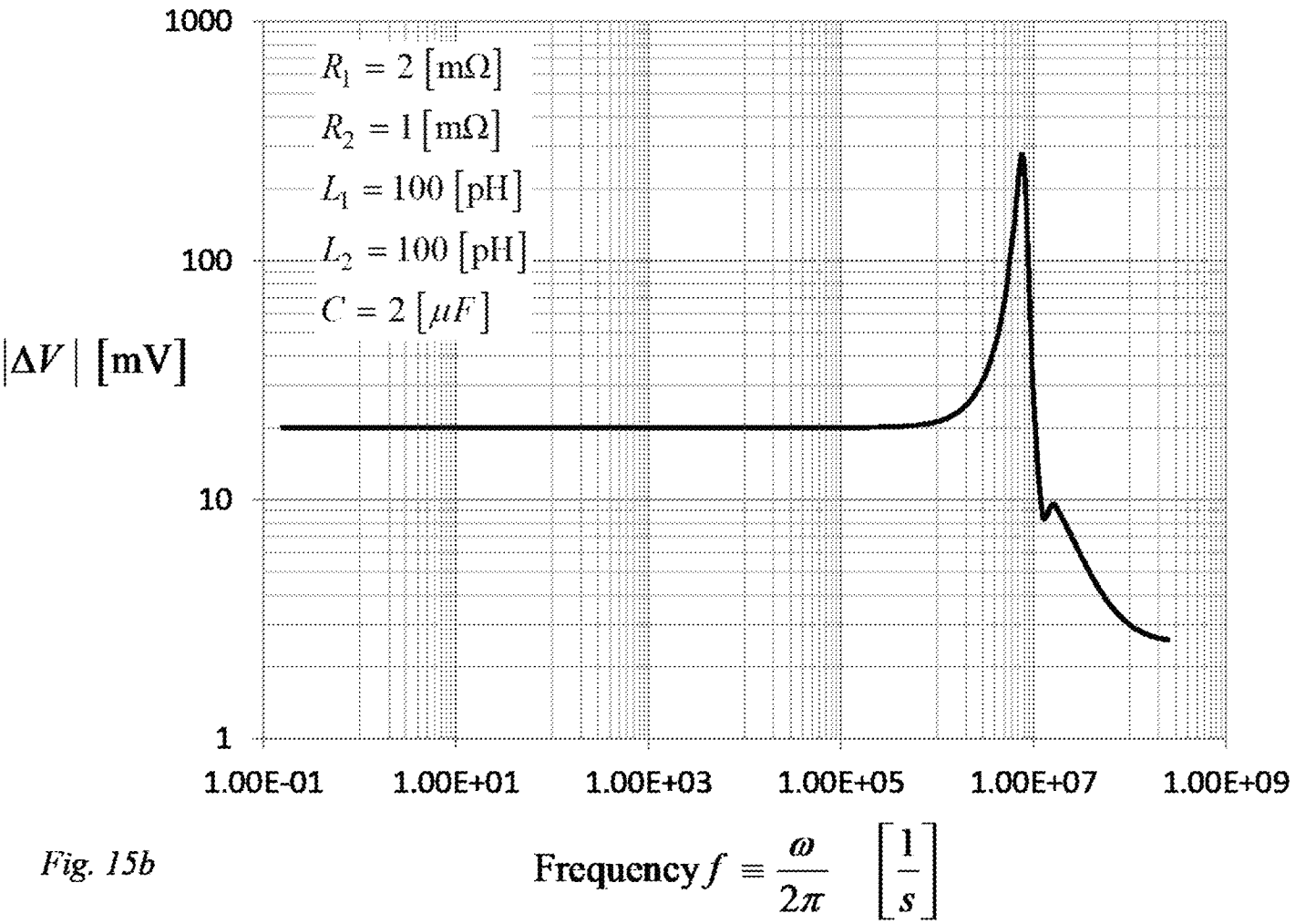
FIG. 15*b* illustrates frequency response of the model of FIG. 14 for capacitance C=2 μF.

On FIG. 15*b*: $C$=2 [μF]

Figure 15C:
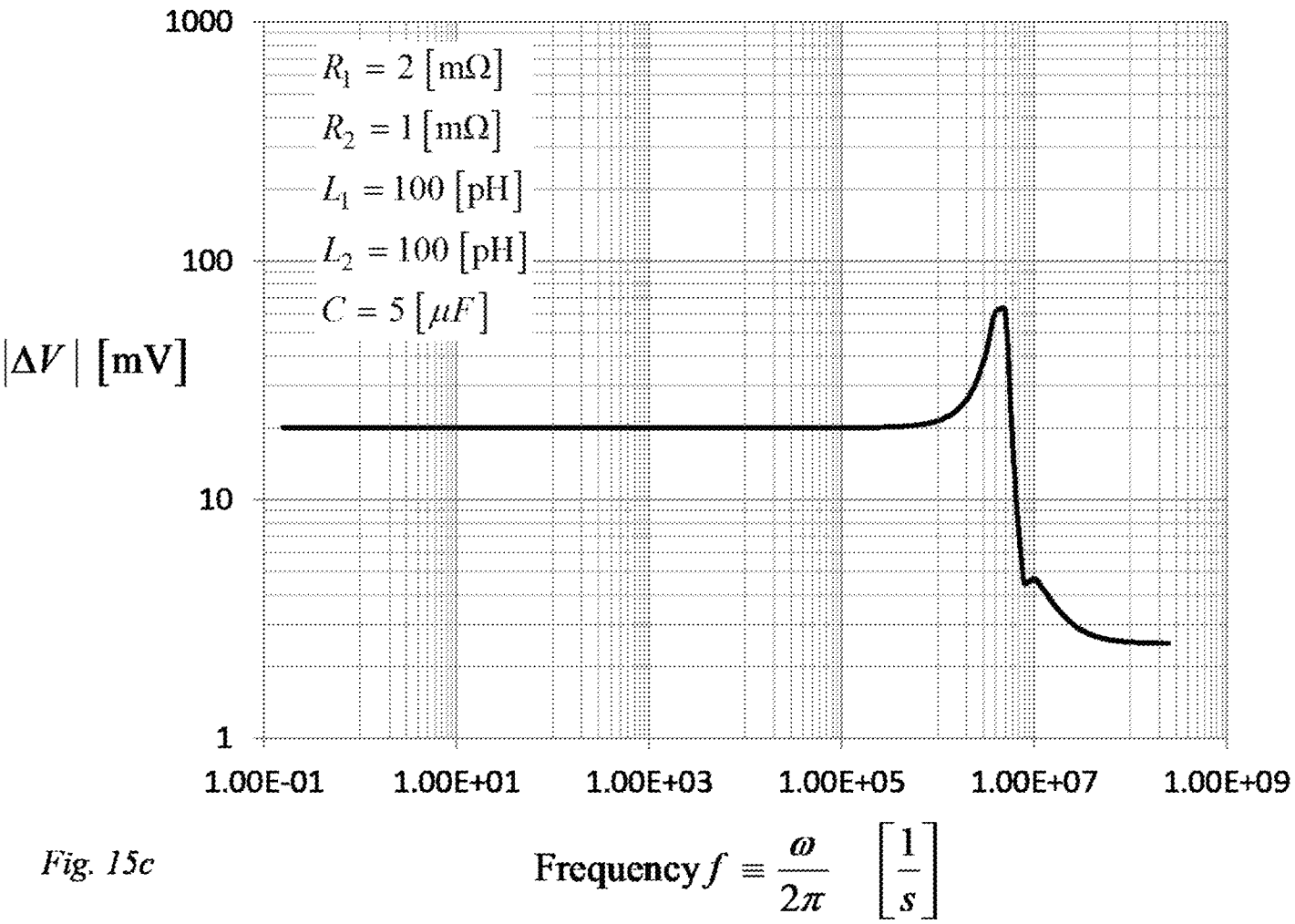
FIG. 15*c* illustrates frequency response of the model of FIG. 14 for capacitance C=5 μF.

On FIG. 15*c*: $C$=5 [μF]

Figure 15D:
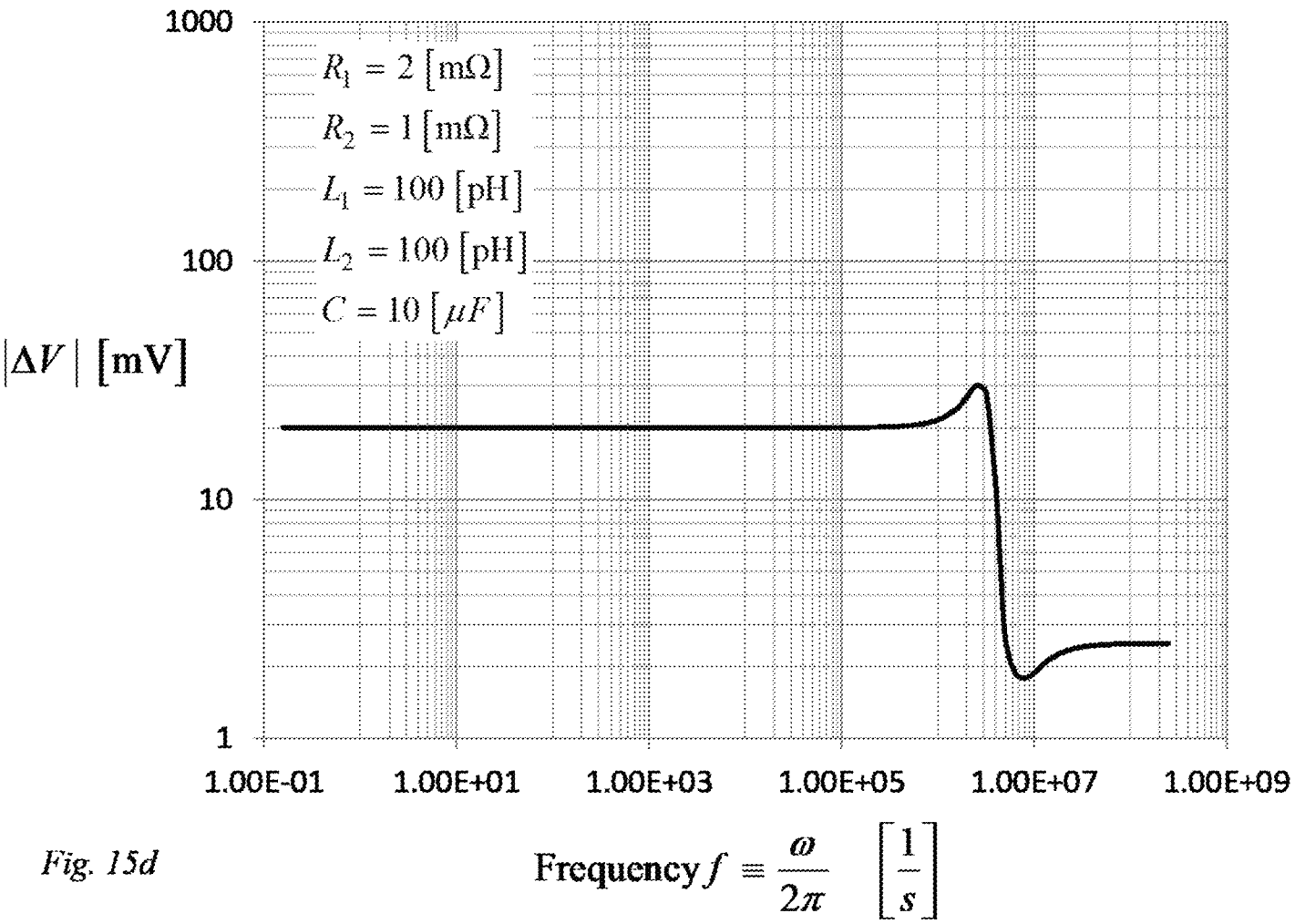
FIG. 15*d* illustrates frequency response of the model of FIG. 14 for capacitance C=10 μF.

On FIG. 15*d*: $C$=10 [μF]

Figure 15E:
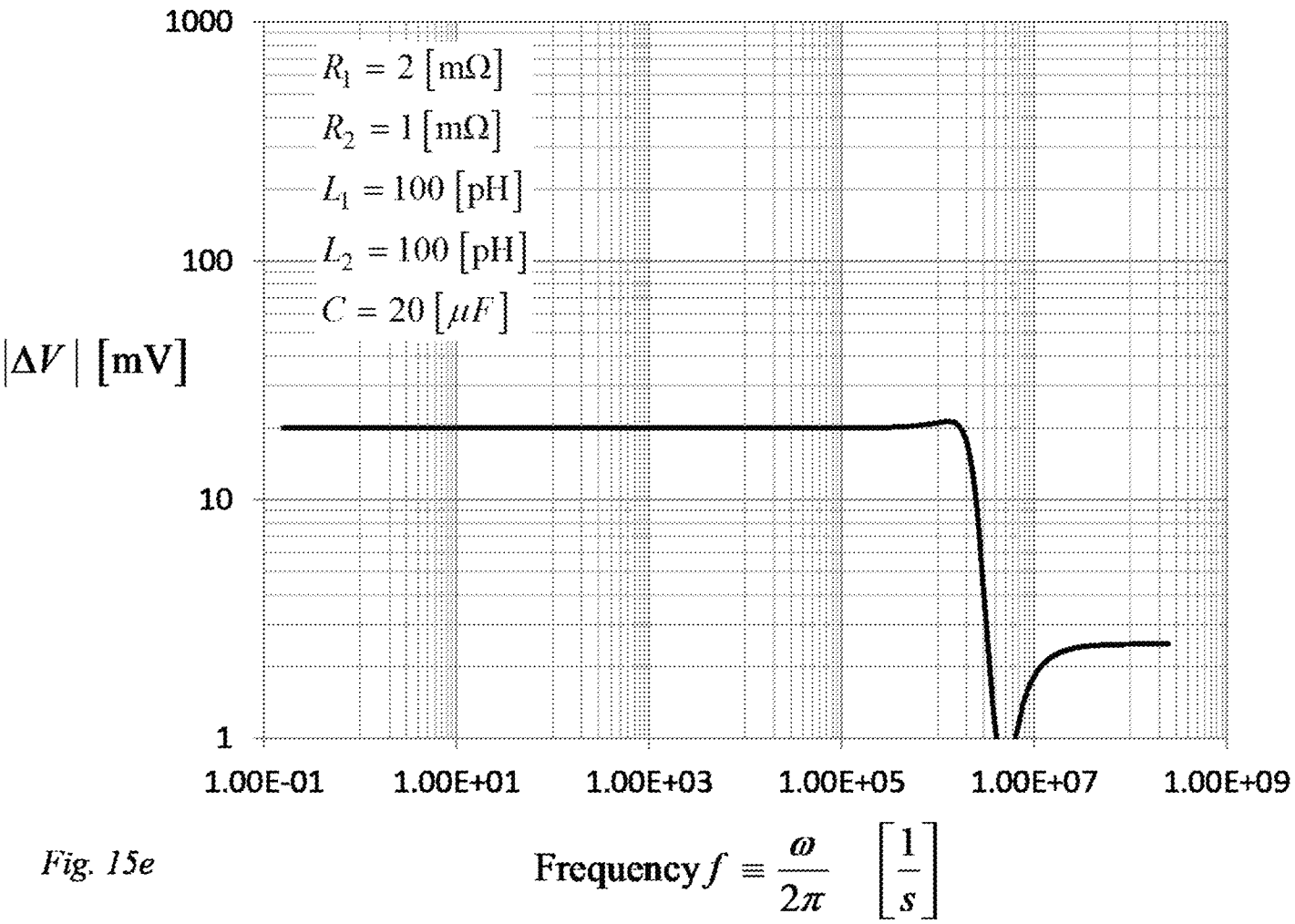
FIG. 15*e* illustrates frequency response of the model of FIG. 14 for capacitance C=20 μF.

On FIG. 15*e*: $C$=20 [μF]

Figure 15F:
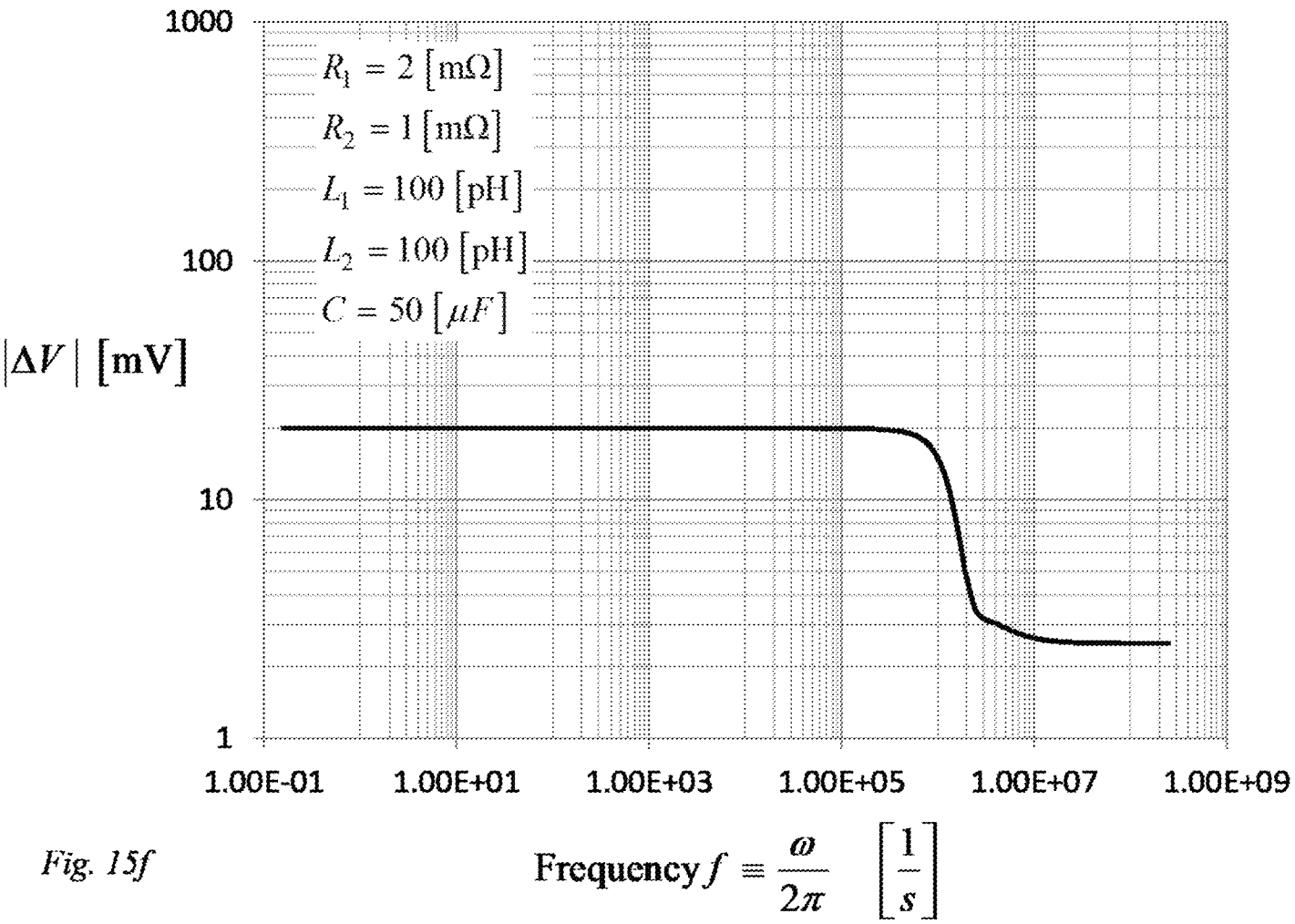
FIG. 15*f* illustrates frequency response of the model of FIG. 14 for capacitance C=50 μF.

On FIG. 15*f*: $C$=50 [μF] (69)

where the other parameters are held constant at the following values:

$R_1$=2 [mΩ]; $R_2$=1 [mΩ]; $L_1$=100 [pH]; $L_2$=100 [pH]; $\Delta I_3$=10 [A]. (70)

The results clearly show the advantage of increasing capacitance C. That is, when C is only 1 μF (FIG. 15*a*), unacceptably large values of |ΔV|—up to 480 mV—occur in the frequency range around 10 MHz. When Cis increased to 5 μF (FIG. 15*c*), the peak value of |ΔV| is reduced to about 62 mV, and when C is increased to 20 μF, the peak value is barely above the low-frequency value of 20 mV, which is independent of C. For C=30 μF and above, further increasing C has no benefit, because, as shown in FIG. 15*f* for C=50 μF, the high-frequency values of |ΔV| are lower than the low-frequency value.

Whereas previous embodiments provided small |ΔV| by keeping $R_1$ and $L_1$ low, this fourth embodiment makes further improvements by providing capacitors 1110 (FIG. 12) that yield capacitance C within the connector. This capacitance C, together with a low connector-to-load inductance provided by vias 1206*a*, 1206*c*, 1208*a*, 1208*c*, further lowers the magnitude |ΔV| of load-voltage variation in response to the time variation in load current $I_3$ given by equation (50).

CONCLUSION, RAMIFICATIONS, AND SCOPE

Thus the reader will see that, in accordance with one or more embodiments, high-current-capacity, low-resistance, low-inductance power connectors may be constructed for a variety of applications in which two electronic entities must be connected and a large, sometimes-fluctuating current passed between them with low loss. One or both entities may be disconnected from the connector, as may be required for servicing. Construction of the connector is straightforward, and manufacturing cost is low. While the above description contains much specificity, this should not be construed as limitations on the scope, but rather as an exemplification of several embodiments thereof. Many other variations are possible.

According to one or more embodiments, an electrical connector is provided for conducting current substantially parallel to a z direction of a Cartesian coordinate system comprising an x axis, a y axis, and a z axis, all mutually orthogonal, thereby defining an xy plane spanned by the x and y axes, an xz plane spanned by the x and z axes, and a yz plane spanned by the y and z axes. The electrical connector includes an anode formed into a first shape of uniform cross-section along the z direction, the first shape having a plurality of anode fingers that alternate with a plurality of anode gaps, and also includes a cathode formed into a second shape of uniform cross-section along the z direction, the second shape having a plurality of cathode fingers that alternate with a plurality of cathode gaps. The first and second shapes provide a conformity of one to the other, with the anode fingers being interdigitated with the cathode fingers and separated from the cathode fingers by an insulative anode-to-cathode gap. In one or more embodiments, the first and second shapes are substantially identical. The negative-z-facing surface of the anode may be substantially coplanar with the negative z-facing surface of the cathode, and the positive-z-facing surface of the anode may be substantially coplanar with the positive-z-facing surface of the cathode. In one or more embodiments, the electrical connector presents resistance of no more than 8.2 micro-ohm and inductance of no more than 185 picohenries. In one or more embodiments, the electrical connector presents a dynamic voltage drop of no more than 50 millivolt for a current varying at a maximum ramp rate of 100 ampere/microsecond. In one or more embodiments, the electrical connector also includes a solder pad and a locating pin for attaching one of the anode or the cathode to a circuit board. In one or more embodiments, the electrical connector also includes a threaded fastener for attaching one of the anode or the cathode to a circuit board. In one or more embodiments, the anode-to-cathode gap is filled with an insulator that has a magnetic permeability within 10 percent of the permeability of free space. In one or more embodiments, a dimension of the anode-to-cathode gap measured between adjacent fingers is less than 0.2 mm.

One or more embodiments provide an electrical connector for conducting current substantially parallel to a z direction of a Cartesian coordinate system having an x axis, a y axis, and a z axis, all mutually orthogonal, thereby defining an xy plane spanned by the x and y axes, an xz plane spanned by the x and z axes, and a yz plane spanned by the y and z axes. The electrical connector includes an anode, a cathode, and an interposer assembly. The anode is formed into a first shape of uniform cross-section along the z direction, the first shape having a plurality of anode fingers that alternate with a plurality of anode gaps. The cathode is formed into a second shape of uniform cross-section along the z direction, the second shape having a plurality of cathode fingers that alternate with a plurality of cathode gaps. The interposer assembly is attached on its positive-z-facing surface to the negative-z-facing surfaces of the anode and cathode, and includes an interposer printed-circuit board and a plurality of capacitors affixed to the interposer printed-circuit board to provide a capacitance. The first and second shapes provide a conformity of one to the other, with the anode fingers being interdigitated with the cathode fingers and separated from the cathode fingers by an insulative anode-to-cathode gap. The anode and the cathode are indented with slots at their negative-z-facing surfaces, and the capacitors of the interposer assembly fit into the slots of the anode and the cathode. In one or more embodiments, the first and second shapes are substantially identical. In one or more embodiments, the negative-z-facing surface of the anode is substantially coplanar with the negative z-facing surface of the cathode, and in which the positive-z-facing surface of the anode is substantially coplanar with the positive-z-facing surface of the cathode. In one or more embodiments, the electrical connector presents resistance of no more than 8.2 micro-ohm and inductance of no more than 185 picohenries. In one or more embodiments, the electrical connector presents a dynamic voltage drop of no more than 50 millivolt for a current varying at a maximum ramp rate of 100 ampere/microsecond. In one or more embodiments, the electrical connector also includes a solder pad and a locating pin for attaching one of the anode or the cathode to a circuit board. In one or more embodiments, the electrical connector also includes a threaded fastener for attaching one of the anode or the cathode to a circuit board. In one or more embodiments, the anode-to-cathode gap is filled by an insulator that has a magnetic permeability within 10 percent of the permeability of free space. In one or more embodiments, a dimension of the anode-to-cathode gap measured between adjacent fingers is less than 0.2 mm. In one or more embodiments, the slots extend continuously across the negative-z-facing surfaces of the anode and the cathode from the positive-y-facing surface to the negative-y-facing surface and define fins therebetween.

One or more aspects provide a method for reducing dynamic voltage drop in a board-to-board assembly. The method includes connecting a source printed-circuit board to a destination printed-circuit board via an interdigitated electrical connector, which includes an anode and a cathode. The anode is formed into a first shape of uniform cross-section along the z direction, the first shape having a plurality of anode fingers that alternate with a plurality of anode gaps. The cathode is formed into a second shape of uniform cross-section along the z direction, the second shape having a plurality of cathode fingers that alternate with a plurality of cathode gaps. The first and second shapes provide a conformity of one to the other, with the anode fingers being interdigitated with the cathode fingers and separated from the cathode fingers by an insulative anode-to-cathode gap. The method further includes providing a time-varying current from the source to the destination via the interdigitated electrical connector.

Accordingly, it will be understood that the descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

REFERENCE NUMERALS

The leading digit(s) of a reference numeral indicates the number of the figure whose discussion introduces it. For example, although reference numeral 302 appears on FIG. 1, it is introduced during the discussion of FIG. 3, so the leading digit is "3".

100 Interdigitated power connector
102 Cartesian coordinate system
104*a* Anode assembly
104*c* Cathode assembly
106*a* Anode
106*c* Cathode
108 Locating pin
110*a* . . . 110*c* Fingers
202 Side gap, in y direction

204 End gap, in x direction
302*a* Hole in anode
302*c* Hole in cathode
400 Board-to-board assembly including connector 100
402 First PCB, to which connector 100 is affixed with fasteners
404 Second PCB, to which connector 100 is affixed by soldering
406*a* Copper pad on PCB 404 to which anode 106*a* is soldered
406*c* Copper pad on PCB 404 to which cathode 106*c* is soldered
410 Holes for locating pins 108
502*a* Threaded fastener engaging an anode hole 302*a*
502*c* Threaded fastener engaging a cathode hole 302*c*
506*a* Copper pad for anode connection
506*c* Copper pads for cathode connection
602 Coordinate system
604 First parallel plate
606 Second parallel plate
800 Connector according to a second embodiment
802*a* Anode
802*c* Cathode
804*a* Threaded portion of hole 302*a*
804*c* Threaded portion of hole 304*c*
806 Board-to-board assembly according to the second embodiment
808 PCB (printed-circuit board)
810*a* Fasteners for anode
810*c* Fasteners for cathode
812*a* Copper pad for anode
812*c* Copper pad for cathode
900 Connector according to a third embodiment
902*a* Anode
902*c* Cathode
906 Board-to-board assembly according to the third embodiment
908*a* Copper pad for anode
908*c* Copper pad for cathode
1000 Board-to-board assembly according to a fourth embodiment
1002 Connector according to the fourth embodiment
1004*a* Anode assembly
1004*c* Cathode assembly
1006 Interposer assembly
1104*a* Anode
1104*c* Cathode
1106 Interposer
1108 Locating pin
1110 Capacitor
1112*a* Copper pad on interposer for anode
1112*c* Copper pad on interposer for cathode
1114*a* Copper pad on board 404 for anode connection
1114*c* Copper pad on board 404 for cathode connection
1202*a* First terminal of capacitor 1110
1202*c* Second terminal of capacitor 1110
1204*a* Copper pad for first terminal 1202*a*
1204*c* Copper pad for second terminal 1202*c*
1206*a* Copper trace connecting pads 1204*a*
1206*c* Copper trace connecting pads 1204*c*
1208*a* Anode stitch vias
1208*c* Cathode stitch vias
1402 Electronic load

What is claimed is:

1. An electrical connector for conducting current substantially parallel to a z direction of a Cartesian coordinate system comprising an x axis, a y axis, and a z axis, all mutually orthogonal, thereby defining an xy plane spanned by the x and y axes, an xz plane spanned by the x and z axes, and a yz plane spanned by the y and z axes, in which context the electrical connector conducts current from a power source at the positive z end of the connector to a power sink at the negative z end of the connector, the electrical connector comprising:

an anode formed into a first shape of uniform cross-section along the z direction, the first shape comprising a plurality of anode fingers that protrude in the positive x direction and alternate with a plurality of anode gaps, the anode having first and second holes indented into respective positive and negative z ends of the anode; and a cathode formed into a second shape of uniform cross-section along the z direction, the second shape comprising a plurality of cathode fingers that protrude in the negative x direction and alternate with a plurality of cathode gaps, the cathode having third and fourth holes indented into respective positive and negative z ends of the cathode, wherein the first and second shapes provide a conformity of one to the other, with the anode fingers being interdigitated with the cathode fingers and separated from the cathode fingers by an insulative anode-to-cathode gap that is entirely filled with an insulator.

2. The electrical connector as claimed in claim 1, wherein the first and second shapes are substantially identical.

3. The electrical connector as claimed in claim 1, wherein the negative-z-facing surface of the anode is substantially coplanar with the negative z-facing surface of the cathode, and in which the positive-z-facing surface of the anode is substantially coplanar with the positive-z-facing surface of the cathode.

4. The electrical connector as claimed in claim 1, wherein the electrical connector presents resistance of no more than 8.2 micro-ohm and inductance of no more than 185 picohenries.

5. The electrical connector as claimed in claim 1, wherein the electrical connector presents a dynamic voltage drop of no more than 50 millivolt for a current varying at a maximum ramp rate of 100 ampere/microsecond.

6. The electrical connector as claimed in claim 1, further comprising a solder pad and a locating pin for attaching one of the anode or the cathode to a circuit board.

7. The electrical connector as claimed in claim 1, further comprising a threaded fastener for attaching one of the anode or the cathode to a circuit board.

8. The electrical connector as claimed in claim 1, wherein the anode-to-cathode gap is filled with an insulator that has a magnetic permeability within 10 percent of the permeability of free space.

9. The electrical connector as claimed in claim 1, wherein a dimension of the anode-to-cathode gap measured between adjacent fingers is less than 0.2 mm.

10. An electrical connector for conducting current substantially parallel to a z direction of a Cartesian coordinate system comprising an x axis, a y axis, and a z axis, all mutually orthogonal, thereby defining an xy plane spanned by the x and y axes, an xz plane spanned by the x and z axes, and a yz plane spanned by the y and z axes, in which context the electrical connector comprises:

an anode formed into a first shape of uniform cross-section along the z direction, the first shape comprising a plurality of anode fingers that alternate with a plurality of anode gaps;

a cathode formed into a second shape of uniform cross-section along the z direction, the second shape comprising a plurality of cathode fingers that alternate with a plurality of cathode gaps; and an interposer assembly, which is attached on its positive-z-facing surface to the negative-z-facing surfaces of the anode and cathode, the interposer assembly comprising an interposer printed-circuit board and a plurality of capacitors affixed to the interposer printed-circuit board to provide a capacitance, wherein the first and second shapes provide a conformity of one to the other, with the anode fingers being interdigitated with the cathode fingers and separated from the cathode fingers by an insulative anode-to-cathode gap, wherein the anode and the cathode are indented with slots at their negative-z-facing surfaces, and the capacitors of the interposer assembly fit into the slots of the anode and the cathode.

11. The electrical connector as claimed in claim 10, wherein the first and second shapes are substantially identical.

12. The electrical connector as claimed in claim 10, wherein the negative-z-facing surface of the anode is substantially coplanar with the negative z-facing surface of the cathode, and in which the positive-z-facing surface of the anode is substantially coplanar with the positive-z-facing surface of the cathode.

13. The electrical connector as claimed in claim 10, wherein the electrical connector presents resistance of no more than 8.2 micro-ohm and inductance of no more than 185 picohenries.

14. The electrical connector as claimed in claim 10, wherein the electrical connector presents a dynamic voltage drop of no more than 50 millivolt for a current varying at a maximum rate of 100 ampere/microsecond.

15. The electrical connector as claimed in claim 10, further comprising a solder pad and a locating pin for attaching one of the anode or the cathode to a circuit board.

16. The electrical connector as claimed in claim 10, further comprising a threaded fastener for attaching one of the anode or the cathode to a circuit board.

17. The electrical connector as claimed in claim 10, wherein the anode-to-cathode gap is filled by an insulator that has a magnetic permeability within 10 percent of the permeability of free space.

18. The electrical connector as claimed in claim 10, wherein a dimension of the anode-to-cathode gap measured between adjacent fingers is less than 0.2 mm.

19. The electrical connector as claimed in claim 10, wherein the slots extend continuously across the negative-z-facing surfaces of the anode and the cathode from the positive-y-facing surface to the negative-y-facing surface and define fins therebetween.

* * * * *